US009595163B2

(12) United States Patent
Elias et al.

(10) Patent No.: US 9,595,163 B2
(45) **Date of Patent: *Mar. 14, 2017**

(54) METHODS AND SYSTEMS FOR A BONUS ROUND OF A GAME WHICH PROVIDES FOR PLAYER INFLUENCE OF VOLATILITY

(71) Applicant: Gamesys Ltd., London (GB)

(72) Inventors: Hans Elias, Hertfordshire (GB); Thomas David James Aicken, London (GB); Marlon James Dublin, Ilford (GB)

(73) Assignee: Gamesys, Ltd., London (GB)

( * ) Notice: Subject to any disclaimer, the term of this patent is extended or adjusted under 35 U.S.C. 154(b) by 123 days.

This patent is subject to a terminal disclaimer.

(21) Appl. No.: 14/699,220

(22) Filed: Apr. 29, 2015

(65) Prior Publication Data

US 2015/0248813 A1 Sep. 3, 2015

Related U.S. Application Data

(63) Continuation of application No. 13/871,176, filed on Apr. 26, 2013, now Pat. No. 9,022,865.

(Continued)

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/3225* (2013.01); *G07F 17/3204* (2013.01); *G07F 17/3241* (2013.01);

(Continued)

(58) Field of Classification Search

CPC .... G07F 17/34; G07F 17/326; G07F 17/3225; G07F 17/3262; G07F 17/3209; A63F 1/06

See application file for complete search history.

(56) References Cited

U.S. PATENT DOCUMENTS

| | | | |
|---|---|---|---|
| 5,851,147 | A | 12/1998 | Stupak et al. |
| 6,364,314 | B1 | 4/2002 | Canterbury |

(Continued)

FOREIGN PATENT DOCUMENTS

| | | |
|---|---|---|
| WO | WO2004079671 | 9/2004 |

OTHER PUBLICATIONS

"Virgin Casino Rolls Out Monopoly Multiplier", Wireless News; May 10, 2010.

(Continued)

*Primary Examiner* — Steve Rowland

(74) *Attorney, Agent, or Firm* — Fincham Downs, LLC; Magdalena M. Fincham

(57) ABSTRACT

In some embodiments, a player may influence the volatility of a bonus round of a game by placing elements collected during a primary game onto symbol positions of the bonus round. In some embodiments, if a symbol position onto which a player placed one or more bonus round symbols is selected as an active symbol position for an event instance of the bonus round, the player wins a prize. Additionally, a multiplier may be applied to the value of the prize or other benefit may be provided to the player if the player placed more than one bonus round symbol element on the position. Thus, a player having a plurality of bonus round symbols to place may choose to increase the frequency of prizes won (e.g., by distributing the bonus round symbols over more positions) or increase the value of prizes (e.g., by grouping more symbols on fewer positions).

10 Claims, 8 Drawing Sheets

Related U.S. Application Data

(60) Provisional application No. 61/800,254, filed on Mar. 15, 2013.

(52) U.S. Cl.
CPC ..... *G07F 17/3267* (2013.01); *G07F 17/3272* (2013.01); *G07F 17/34* (2013.01); *Y10T 436/106664* (2015.01); *Y10T 436/107497* (2015.01); *Y10T 436/108331* (2015.01); *Y10T 436/109163* (2015.01)

(56) References Cited

U.S. PATENT DOCUMENTS

| | | | |
|---|---|---|---|
| 7,018,293 | B2 | 3/2006 | Brown et al. |
| 7,185,890 | B2 | 3/2007 | Trivedi |
| 7,285,048 | B2 | 10/2007 | Karmarkar |
| 7,294,054 | B2 | 11/2007 | Schugar et al. |
| 7,662,040 | B2 | 2/2010 | Englman et al. |
| 7,713,122 | B2 | 5/2010 | Pacey |
| 7,892,088 | B2 | 2/2011 | Brandstetter et al. |
| 7,901,283 | B2 | 3/2011 | Thomas et al. |
| 7,980,933 | B2 | 7/2011 | Kennedy |
| 8,087,983 | B2 | 1/2012 | Longway |
| 8,371,927 | B2 | 2/2013 | Englman |
| 8,523,647 | B2 | 9/2013 | McClintic |
| 8,622,811 | B1 | 1/2014 | Aoki et al. |
| 2002/0132659 | A1 | 9/2002 | DeMar et al. |
| 2006/0033276 | A1 | 2/2006 | Evans et al. |
| 2007/0167208 | A1 | 7/2007 | Acres |
| 2007/0248936 | A1 | 10/2007 | Huff |
| 2009/0115133 | A1 | 5/2009 | Kelly et al. |
| 2010/0004056 | A1* | 1/2010 | Walker ..... G07F 17/32 463/25 |
| 2010/0320690 | A1 | 12/2010 | Pollack |
| 2011/0039614 | A1 | 2/2011 | Caputo et al. |
| 2011/0111831 | A1 | 5/2011 | Seelig et al. |
| 2014/0087879 | A1 | 3/2014 | Basallo et al. |

OTHER PUBLICATIONS

Office Action for U.S. Appl. No. 13/871,176 dated Sep. 5, 2014; 11 pps.

Notice of Allowance for U.S. Appl. No. 13/871,176 dated Jan. 5, 2015; 7 pps.

* cited by examiner

METHODS AND SYSTEMS FOR A BONUS ROUND OF A GAME WHICH PROVIDES FOR PLAYER INFLUENCE OF VOLATILITY

CLAIM OF PRIORITY

The present application is a continuation application of U.S. application Ser. No. 13/871,176 filed on Apr. 26, 2013 in the name of Elias et al. and entitled METHODS AND SYSTEMS FOR A BONUS ROUND OF A GAME WHICH PROVIDES FOR PLAYER INFLUENCE OF VOLATILITY, which application claims the benefit of priority of U.S. Provisional Patent Application Ser. No. 61/800,254, filed Mar. 15, 2013 in the name of Elias et al. and entitled METHODS AND SYSTEMS FOR A BONUS ROUND OF A GAME WHICH PROVIDEs FOR PLAYER INFLUENCE OF VOLATILITY. The entirety of each of these applications is incorporated by reference herein for all purposes.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

At least some embodiments described herein relate to electronic games (e.g., such as online wagering games) which include a primary game and a bonus round, and particularly to methods and systems for allowing a player to affect the volatility of a bonus round via placement of bonus symbols the player obtained during play of the primary game.

DETAILED DESCRIPTION OF EXAMPLE EMBODIMENTS

Figure 1:
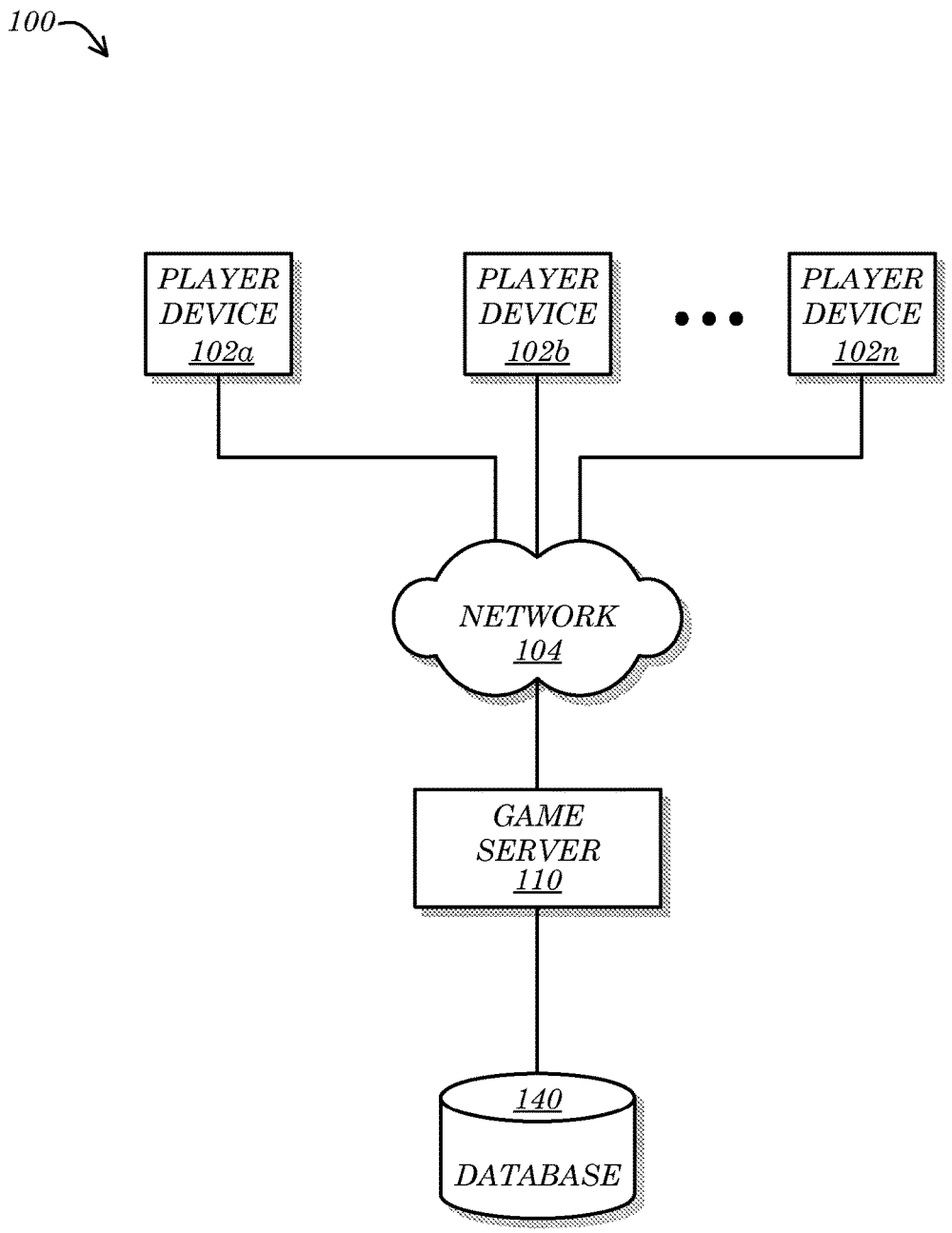
FIG. 1 is a schematic diagram of an embodiment of a gaming system in accordance with one or more embodiments described herein.

Games, whether wagering or non-wagering, are a popular past-time for millions of people all over the world. Electronic games in particular are becoming more and more popular, particularly ones playable online using a computer connected to a network. For example, according to some reports more than 200 million people play social games every month and online games recently passed e-mail as the second-most popular activity online, second only behind social networking. Accordingly, there is a need to continue to create exciting electronic games which maintain players' interest and stand out from the multitude of available online games.

Applicants have recognized that games which would allow a player some level of influence or control over the volatility of an aspect of the game (e.g., to balance or trade-off a magnitude of the value(s) of potential prizes against the frequency of such prizes) may be particularly appealing to some players and provide herein a game mechanic which allows a player to affect the volatility of a bonus round of a game. Applicants have further recognized that games in which a player acquires some form of equity over a plurality of spins or game instances of the game (e.g., games playable over a session in which a plurality of event instances contribute to a session result) are particularly enjoyable to many players, as they allow for a build-up of excitement over a period of time and over the plurality of event instances and maintain the player's attention for an extended period of time. Applicants have thus created a game, playable online (e.g., which may be embodied as a wagering game) and over a session and which includes a primary game in which a player may win bonus game symbols usable in a bonus round of the game, wherein the player may place one or more of such bonus game symbols on one or more available symbol positions of a game interface for the bonus round, or otherwise select symbol positions of a game interface of the bonus round, in a manner which influences the volatility of the bonus round.

Accordingly, one or more embodiments comprise a method (as well as systems and articles of manufacture (such as non-transitive computer readable media which cause a processor of a computing device to perform said method)) which provides for (i) determining that a first player of a primary game has qualified for entry into a bonus round of the primary game; (ii) outputting, via a player device associated with the player, a game interface of the bonus round, the game interface comprising a plurality of available symbol positions available for selection by the player; (iii) determining one or more elements available to the player due to having been obtained by the player as a result of game play of the primary game, the one or more elements being available to the player for placement on the available symbol position of the plurality of available symbol positions, wherein the player may place more than one of the elements on a particular available symbol position in order to increase a default value of a prize associated with the symbol position; (iv) determining which of the available symbol positions the player has placed one or more elements on, thereby determining at least one player selected symbol position; (v) determining, for a game instance of the bonus round, an active symbol position for the game instance; (vi) determining, for the game instance, an outcome and a prize corresponding to the outcome; (vii) determining whether the active symbol position is a player selected symbol position; (viii) if the active symbol position is a player selected symbol position, determining an actual value of the prize to output to the player based on a default value of the prize and a number of elements the player has placed on the player selected symbol position; and (ix) outputting a prize of the actual value to the player. It should be noted that the terms "bonus element(s)", "bonus round element(s)", "bonus symbol(s)" and "bonus round symbol(s) are used interchangeably herein. Similarly, the terms "element(s" and "symbol(s)" are used interchangeably herein.

One or more embodiments comprise a method (as well as systems and articles of manufacture (such as non-transitive computer readable media which cause a processor of a computing device to perform said method)) which facilitating a bonus round of an electronic game, the bonus round comprising a plurality of positions, wherein the player is provided with a plurality of elements to place on the positions and wherein more than one element may be placed on a given position, in which game the player influences the volatility of the game by making selections which balance higher frequency of payouts against higher magnitude of payouts by choosing whether to place more elements of the plurality of available elements on fewer available positions or to spread the available elements out among more available positions such that each position has fewer elements, and in which game a larger number of player-placed elements on a position results in a higher payout to the player if the position on which the player placed the elements is selected (e.g., randomly) as an active position for a round of the game.

One or more embodiments comprise a method (as well as systems and articles of manufacture (such as non-transitive computer readable media which cause a processor of a computing device to perform said method)) which provides for (i) determining an active position for a game instance of a bonus round of the game (e.g., a position which may result in a payout to the player if the player previously placed one or more elements on the position); (ii) determining whether the player previously placed one or more elements on the position; (iii) determining a base payout associated with the position (e.g., based on the outcome of reels of a reel game aspect of the bonus round); and (iv) determining a final payout for the position in the current round of the game based on the number of elements the player previously placed on the position.

One or more embodiments comprise a method (as well as systems and articles of manufacture (such as non-transitive computer readable media which cause a processor of a computing device to perform said method)) which provides for determining a multiplier to apply to a payout of a game instance (e.g., of a bonus round) of a game by determining placement, by a player of the round of the game, of one or more elements of the game on a position of an interface of the game. In accordance with some embodiments, the more elements the player placed on the position, the higher the multiplier. In accordance with some embodiments, the game is a MONOPOLY™-themed game and the positions comprise properties in the MONOPOLY™-themed game. In accordance with some embodiments, the elements placed by the player in the bonus round of the game are obtained by the player during a primary game associated with the bonus round (e.g., the elements may have been awarded to the player as a result of random results obtained by the player in the primary game).

Certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

Although several embodiments, examples and illustrations are disclosed below, it will be understood by those of ordinary skill in the art that the invention described herein extends beyond the specifically disclosed embodiments, examples and illustrations and includes other uses of the invention and obvious modifications and equivalents thereof. Embodiments of the invention(s) are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the invention(s). In addition, embodiments of the invention(s) can comprise several novel features and it is possible that no single feature is solely responsible for its desirable attributes or is essential to practicing the invention(s) herein described.

Throughout the description that follows and unless otherwise specified, the following terms may include and/or encompass the example meanings provided in this section. These terms and illustrative example meanings are provided to clarify the language selected to describe embodiments both in the specification and in the appended claims, and accordingly, are not intended to be limiting. Other terms are defined throughout the present description.

A "game", as the term is used herein unless specified otherwise, may comprise any game (e.g., wagering or non-wagering, electronically playable over a network) playable by one or more players in accordance with specified rules. A game may be playable on a personal computer online in web browsers, on a game console and/or on a mobile device such as a smart-phone or tablet computer. "Gaming" thus refers to play of a game.

A "casual game", as the term is used herein unless specified otherwise, may comprise a game with simple rules with little or no time commitment on the time of a player to play. A casual game may feature, for example, very simple game play such as a puzzle or Scrabble™ game, may allow for short bursts of play (e.g., during work breaks), an ability to quickly reach a final stage and/or continuous play without a need to save the game.

A "social network game", as used herein unless specified otherwise, refers to a type of online game that is played through a social network, and in some embodiments may feature multiplayer and asynchronous game play mechanics. A "social network" may refer to an online service, online community, platform, or site that focuses on facilitating the building of social networks or social relations among people. A social network service may, for example, consist of a representation of each user (often a profile), his/her social links, and a variety of additional services. A social network may be web-based and provide means for users to interact over the Internet, such as e-mail and instant messaging. A social network game may in some embodiments be implemented as a browser game, but can also be implemented on other platforms such as mobile devices.

A "wagering game", as the term is used herein, may comprise a game on which a player can risk a wager or other consideration, such as, but not limited to: slot games, poker games, blackjack, baccarat, craps, roulette, lottery, bingo, keno, casino war, etc. A wager may comprise a monetary wager in the form of an amount of currency or any other tangible or intangible article having some value which may be risked on an outcome of a wagering game. "Gambling" or "wagering" refers to play of a wagering game.

The term "game provider", as used herein unless specified otherwise, refers to an entity or system of components which provides games for play and facilitates play of such game by use of a network such as the Internet or a proprietary or closed networks (e.g., an intranet or wide area network). For example, a game provider may operate a website which provides games in a digital format over the Internet. In some embodiments in which a game comprising a wagering game is provided, a game provider may operate a gambling website over which wagers are accepted and results of wagering games are provided.

The terms "information" and "data", as used herein unless specified otherwise, may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard as defined by "Internet Protocol Version 6 (IPv6) Specification" RFC 1883, published by the Internet Engineering Task Force (IETF), Network Working Group, S. Deering et al. (December 1995). Information may, according to some embodiments, be compressed, encoded, encrypted, and/or otherwise packaged or manipulated in accordance with any method that is or becomes known or practicable.

The term "indication", as used herein unless specified otherwise, may refer to any indicia and/or other information indicative of or associated with a subject, item, entity, and/or other object and/or idea. As used herein, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

The term "network component," as used herein unless specified otherwise, may refer to a user or network device, or a component, piece, portion, or combination of user or network devices. Examples of network components may include a Static Random Access Memory (SRAM) device or module, a network processor, and a network communication path, connection, port, or cable.

In addition, some embodiments are associated with a "network" or a "communication network". As used herein, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration of type that is or becomes known. Communication networks may include, for example, one or more networks configured to operate in accordance with the Fast Ethernet LAN transmission standard 802.3-2002® published by the Institute of Electrical and Electronics Engineers (IEEE). In some embodiments, a network may include one or more wired and/or wireless networks operated in accordance with any communication standard or protocol that is or becomes known or practicable.

The term "player," as used herein unless specified otherwise, may refer to any type, quantity, and or manner of entity associated with the play of a game. In some embodiments, a player may comprise an entity (i) conducting play of an online game, (ii) that desires to play a game (e.g., an entity registered and/or scheduled to play and/or an entity having expressed interest in the play of the game—e.g., a spectator) and/or may (iii) that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game).

Some embodiments described herein are associated with a "player device" or a "network device". As used herein, a "player device" is a subset of a "network device". The "network device", for example, may generally refer to any device that can communicate via a network, while the "player device" may comprise a network device that is owned and/or operated by or otherwise associated with a player. Examples of player and/or network devices may include, but are not limited to: a Personal Computer (PC), a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Player and/or network devices may, in some embodiments, comprise one or more network components.

A "session" comprises a period of time spanning a plurality of event instances, game instances or turns of the game, the session having a defined start and defined end. An "event instance", "game instance" or "turn" is triggered upon an initiation of, or request for, at least one result of the game by a player, such as an actuation of a "start" or "spin" mechanism, which initiation causes an outcome to be determined or generated (e.g., a random number generator is contacted or communicated with to identify, generate or determine a random number to be used to determine a result for the event instance). An event instance or turn may comprise an event instance or turn of a primary game or an event instance or turn of a bonus round, mode or feature of the game. Accordingly, a session may refer to a session of a primary game or a session of a bonus round, mode or feature of the game, depending on the context.

An "outcome" should be differentiated from a "result" in the present description in that an "outcome" is a representation of a "result", typically comprising one or more game elements or game symbols. For example, in a "fruit themed" game, a winning outcome (i.e., an outcome corresponding to some kind of award, prize or payout) may comprise a combination of three "cherry" symbols. The "result" of this outcome may be a payout of X credits awarded to the player associated with the game. In another example, in a game in which a character moves along a game interface from a starting position to a finish position, an "outcome" of the game may comprise a symbol representing one or more movements along the interface and the "result" corresponding to this outcome may be the particular number and direction of the character's movement (e.g., three spaces backwards such that the character ends up further away from the finish line). In a session embodiment, a session result may comprise a binary result (e.g., a player or game character wins or loses the session) and/or the particular award (or magnitude of award) won or earned by the player based on the session (e.g., the number of credits awarded to the player). It should be noted that the embodiments described herein encompass prizes which may comprise awards, payouts, discounts, eligibility, advancement in a game or other benefits (whether monetary or non-monetary, tangible or intangible) to a player.

A "bonus round symbol", as the term is used herein unless indicated otherwise, may refer to one or more symbols or elements of a game which are obtained (e.g., won as a result of, or part of, an outcome) in a primary game and, once the player qualifies for a bonus round, are usable by the player in the bonus round in order to affect one or more characteristics (e.g., volatility) of the bonus round. In one embodiment, a bonus round symbol is usable by a player to select one or more symbol positions available in the bonus round as "active positions", meaning that if a game character position or other outcome of the bonus round corresponds to an active position as selected by the player, the player will qualify for a prize.

A "bonus round", "bonus mode" or "bonus feature" of a game, as the terms are used interchangeably herein unless indicated otherwise, may refer to a secondary game, entry into which is triggered via one or more events which may occur in a base or primary game. Typically, a player may be able to qualify to play a bonus game based on one or more outcomes in a primary game, such as in a basic mode or a qualifying mode. A bonus round may be played in accordance with a set of rules that is different from those of a primary game, and may be accompanied by displays, colors, sounds, animated sequences, game play and/or prizes that are not part of the primary game. In one embodiment, a primary or base game application or program may include programming or instructions which will automatically begin a bonus round after the player has achieved a triggering event or qualifying condition in the base or primary game.

"Virtual currency" as the term is used herein unless indicated otherwise, refers to an in-game currency that may be used as part of a game or one or more games provided by a game provider as (i) currency for making wagers, and/or (ii) to purchase or access various in-game items, features or powers.

A "credit balance", as the term is used herein unless indicated otherwise, refers to (i) a balance of currency, whether virtual currency or real currency, usable for making wagers in the game and/or (ii) another tracking mechanism for tracking a player's success or advancement in a game by deducting therefrom points or value for unsuccessful attempts at advancement and adding thereto points or value for successful attempts at advancement.

FIG. 1 depicts a block diagram of an example system 100 according to some embodiments. The system 100 may comprise a plurality of player devices 102*a*-102*n* in communication with a game server 110 via a network 104. For purposes of brevity, any or all of the player devices 102*a*-102*n* will be referred to as a player device 102 herein, even though the plurality of player devices 102*a*-102*n* may include different types of player devices (as described below). The game server 110 may also be operable to communicate with or access a database 140 (which may comprise one or more databases and/or tables and which may comprise a storage device distinct from (or be a component of) the game server 110). It should be noted that in some embodiments database 140 may be stored on a game server 110 while in other embodiments database 140 may be stored on another computing device with which game server 110 is operable to communicate in order to at least access the data in database 140 (e.g., another server device remote from game server 140, operable to determine outcomes for an event instance of a game). In some embodiments a processor (e.g., one or more microprocessors, one or more microcontrollers, one or more digital signal processors) of a player device 102 and/or game server 110 may receive instructions (e.g., from a memory or like device), and execute those instructions, thereby performing one or more processes defined by those instructions. Instructions may be embodied in, e.g., one or more computer programs and/or one or more scripts.

In some embodiments a game server 110 and/or one or more of the player devices 102 stores and/or has access to data useful for facilitating play of a game. For example, game server 110 and/or a player device 102 may store (i) one or more probability databases for determining one or more outcome(s) for an event instance or turn of a game, (ii) a current state or status of a game or game session, (iii) one or more user interfaces for use in a game, (iv) one or more game themes for a game and/or (v) profiles or other personal information associated with a player of a game. It should be noted that in some embodiments such data may be stored on the game server 110 and information based on such data may be output to a player device 102 during play of a game while in other embodiments a game program may be downloaded to a local memory of a player device 102 and thus such data may be stored on a player device 102 (e.g., in encrypted or other secure or tamper-resistant form).

A game server 110 may comprise a computing device for facilitating play of a game (e.g., by receiving an input from a player, determining an outcome for a game, causing an outcome of a game to be displayed on a player device, facilitating a wager and/or a provision of a payout for a game). For example, the game server 110 may comprise a server computer operated by a game provider or another entity (e.g., a social network website not primarily directed at providing games). In some embodiments, the game server may determine an outcome for a first aspect and/or second aspect of a game by requesting and receiving such an outcome from another remote server operable to provide such outcomes. In some embodiments, the game server 110 may further be operable to facilitate a game program for a game (e.g., a wagering game). In accordance with some embodiments, in addition to administering or facilitating play of a game, a game server 110 may comprise one or more computing devices responsible for handling online processes such as, but not limited to: serving a website comprising one or more games to a player device and/or processing transactions (e.g., wagers, deposits into financial accounts, managing accounts, controlling games, etc). In some embodiments, game server 110 may comprise two or more server computers operated by the same entity (e.g., one server being primarily for storing states of games in progress and another server being primarily for storing mechanisms for determining outcomes of games, such as a random number generator). Examples of processes that may be performed by the game server 110 (directly or indirectly) may include, but are not limited to: (i) determining a movement direction (e.g., advance or fall back) and/or an extent or amount of movement (e.g., a number of predetermined spaces or units of movement along a grid, axis or path) of a game element or game character; (ii) determining which probability table(s) or section(s) of a probability table to utilize for a particular event instance; (iii) determining a first outcome and a second outcome for a particular game instance; (iv) transmitting an indication of a first outcome and a second outcome to a player device; (v) authorizing a game program to be downloaded to a player device; and/or (vi) modifying (or directing a player device to modify) a game interface which is outputting a first outcome such that a second outcome of the game instance becomes discernible to an associated player.

Turning now to a description of a player device 102, in accordance with some embodiments a player device 102 may comprise a computing device that is operable to execute or facilitate the execution of a game program and used or useful by an online player for accessing an online casino or other electronic (e.g., online) game provider. For example, a player device 102 may comprise a desktop computer, computer workstation, laptop, mobile device, tablet computer, Personal Digital Assistant (PDA) devices, cellular or other wireless telephones (e.g., the Apple™ iPhone™), video game consoles (e.g., Microsoft™ Xbox 360™, Sony™ Plasystation™, and/or Nintendo™ Wii™), and/or handheld or portable video game devices (e.g., Nintendo™ Game Boy™ or Nintendo™ DS™). A player device 102 may comprise and/or interface with various components such as input and output devices (each of which is described in detail elsewhere herein) and, in some embodiments, game server 110. A player device 102 may be a dedicated gaming device (e.g., a slot machine) or a non-dedicated gaming device (e.g., an iPad™). It should be noted that a game server 110 may be in communication with a variety of different types of player devices 102.

A player device 102 may be used to play a wagering or non-wagering game (e.g., a social or casual game) over a network and output information relating to the game to players participating in the game (e.g., outcomes for an event instance of the game, qualifying for a bonus round of the game, credit balance of credits available for play of the game, a session result for a session of the game, etc.). Any and all information relevant to any of the aforementioned functions may be stored locally on one or more of the player devices 102 and/or may be accessed using one or more of the player devices 102 (in one embodiments such information being stored on, or provided via, the game server 110). In another embodiment, a player device 102 may store some or all of the program instructions for determining, for example, (i) that an event instance has been triggered or initiated (and, in some embodiments, communicating such a trigger or initiation to game server 110), (ii) a first outcome for a first aspect of the game and a second outcome for a second aspect of the game; (iii) a first result and/or a second result, and/or (iv) determining a session result. In some embodiments, the game server 110 may be operable to authorize the one or more player devices 102 to access such information and/or program instructions remotely via the network 104 and/or download from the game server 110 (e.g., directly or via an intermediary server such as a web server) some or all of the program code for executing one or more of the various functions described in this disclosure. In other embodiments, outcome and result determinations may be carried out by the game server 110 (or another server with which the game server 110 communicates) and the player devices 102 may be terminals for displaying to an associated player such outcomes and results and other graphics and data related to a game.

It should be noted that the one or more player devices 102 may each be located at the same location as at least one other player device 102 (e.g., such as in a casino or internet café) or remote from all other player devices 102. Similarly, any given player device may be located at the same location as the game server 110 or may be remote from the game server 110. It should further be noted that while the game server 110 may be useful or used by any of the player devices 102 to perform certain functions described herein, the game server 110 need not control any of the player devices 102. For example, in one embodiment the game server 110 may comprise a server hosting a website of an online casino accessed by one or more of the player devices 102.

In one embodiment, a game server 110 may not be necessary or desirable. For example, some embodiments described in this disclosure may be practiced on one or more player devices 102 without a central authority. In such an embodiment, any functions described herein as performed by a game server 110 and/or data described as stored on a game server 110 may instead be performed by or stored on one or more player devices 102. Additional ways of distributing information and program instructions among one or more player devices 102, a game server 110 and/or another server device will be readily understood by one skilled in the art upon contemplation of the present disclosure.

Figure 2:
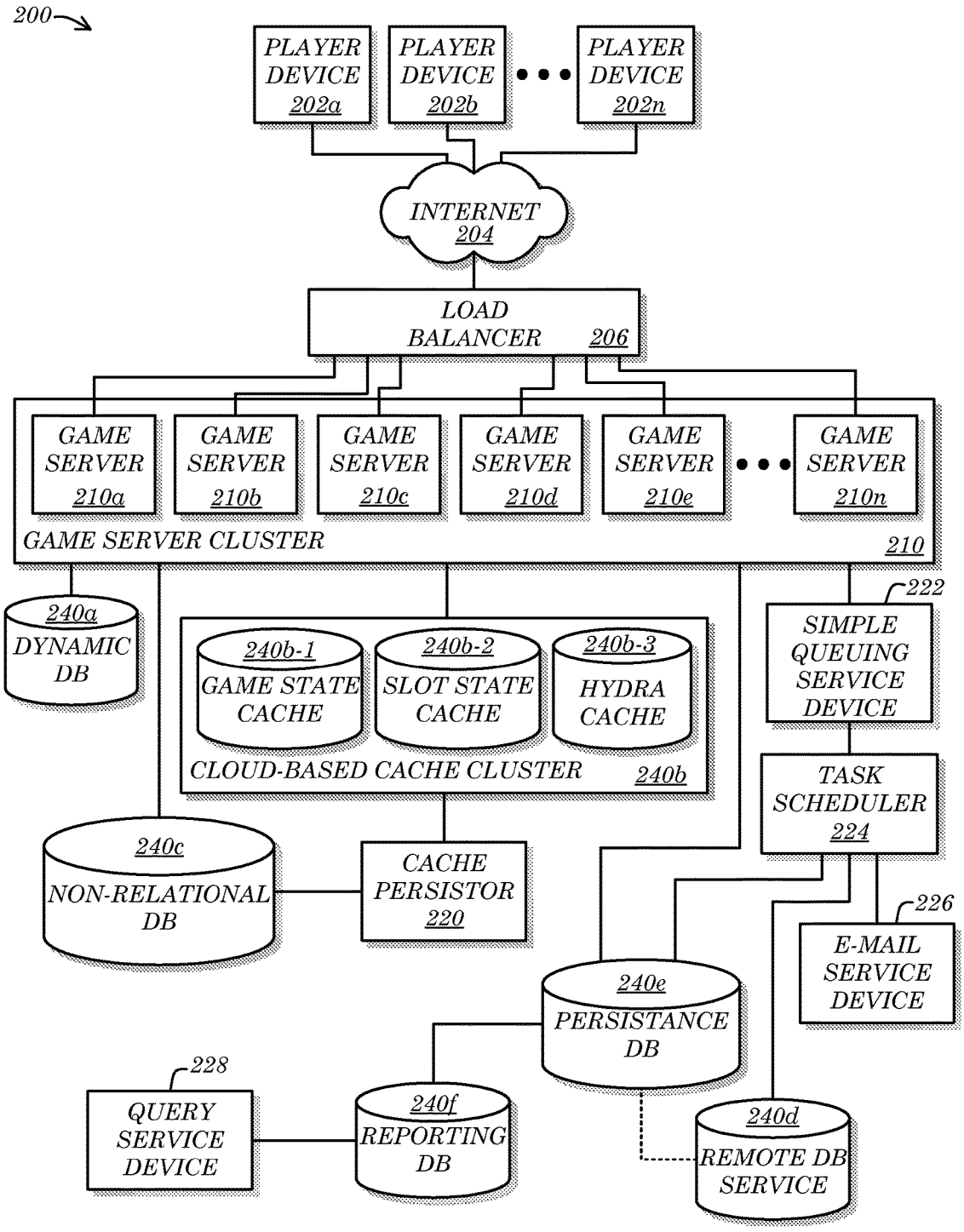
FIG. 2 is a schematic diagram of an embodiment of a social gaming platform in accordance with one or more embodiments described herein.

FIG. 2 a block diagram of a system 200 according to some embodiments is shown. In some embodiments, the system 200 may comprise a plurality of player devices 202*a-n*, the Internet 204, a load balancer 206, and/or a game server cluster 210. The game server cluster 210 may, in some embodiments, comprise a plurality of game servers 210*a-n*. In some embodiments, the system 200 may comprise a cache persistor 220, a Simple Queuing Service (SQS) device 222, a task scheduler 224, an e-mail service device 226, and/or a query service device 228. As depicted in FIG. 2, any or all of the various components 202*a-n*, 204, 206, 210*a-n*, 220, 222, 224, 226, 228 may be in communication with and/or coupled to one or more databases 240*a-f*. The system 200 may comprise, for example, a dynamic DataBase (DB) 240*a*, a cloud-based cache cluster 240*b* (e.g., comprising a game state cache 240*b*-1, a slot state cache 240*b*-2, and/or a "hydra" cache 240*b*-3), a non-relational DB 240*c*, a remote DB service 240*d*, a persistence DB 240*e*, and/or a reporting DB 240*f*.

According to some embodiments, any or all of the components 202*a-n*, 204, 206, 210*a-n*, 220, 222, 224, 226, 228, 240*a-f* of the system 200 may be similar in configuration and/or functionality to any similarly named and/or numbered components described herein. Fewer or more components 202*a-n*, 204, 206, 210*a-n*, 220, 222, 224, 226, 228, 240*a-f* (and/or portions thereof) and/or various configurations of the components 202*a-n*, 204, 206, 210*a-n*, 220, 222, 224, 226, 228, 240*a-f* may be included in the system 200 without deviating from the scope of embodiments described herein. While multiple instances of some components 202*a-n*, 210*a-n*, 240*a-f* are depicted and while single instances of other components 204, 206, 220, 222, 224, 226, 228 are depicted, for example, any component 202*a-n*, 204, 206, 210*a-n*, 220, 222, 224, 226, 228, 240*a-f* depicted in the system 200 may comprise a single device, a combination of devices and/or components 202*a-n*, 204, 206, 210*a-n*, 220, 222, 224, 226, 228, 240*a-f*, and/or a plurality of devices, as is or becomes desirable and/or practicable. Similarly, in some embodiments, one or more of the various components 202*a-n*, 204, 206, 210*a-n*, 220, 222, 224, 226, 228, 240*a-f* may not be needed and/or desired in the system 200.

According to some embodiments, the player device 202*a-n* may be utilized to access (e.g., via the Internet 204 and/or one or more other networks not explicitly shown) content provided by the game server cluster 210. The game server cluster 210 may, for example, provide, manage, host, and/or conduct various online and/or otherwise electronic games such as online bingo, slots, poker, and/or other games of chance, skill, and/or combinations thereof. In some embodiments, the various game servers 210*a-n* (virtual and/or physical) of the game server cluster 210 may be configured to provide, manage, host, and/or conduct individual instances of available game types. A first game server 210*a*, for example, may host a first particular instance of an online bingo game (or tournament), a second game server 210*c* may host a second particular instance of an online bingo game (or tournament), a third game server 210*c* may facilitate an online poker tournament, and/or a fourth game server 210*d* may provide an online slots game.

In some embodiments, the player devices 202*a-n* may comprise various components (hardware, firmware, and/or software; not explicitly shown) that facilitate game play and/or interaction with the game server cluster 210. The player device 202*a-n* may, for example, comprise a gaming client such as a software application programmed in Adobe® Flash® and/or HTML 5 that is configured to send requests to, and receive responses from, one or more of the game servers 210*a-n* of the game server cluster 210. In some embodiments, such an application operating on and/or via the player devices 202*a-n* may be configured in Model-View-Controller (MVC) architecture with a communication manager layer responsible for managing the requests to/responses from the game server cluster 210. In some embodiments, one or more of the game servers 210*a-n* may also or alternatively be configured in a MVC architecture with a communication manager and/or communications management layer. In some embodiments, communications between the player devices 202*a-n* and the game server cluster 210 may be conducted in accordance with the HyperText Transfer Protocol (HTTP) version 1.1 (HTTP/1.1) as published by the Internet Engineering Taskforce (IET) and the World Wide Web Consortium (W3C) in RFC 2616 (June 1999).

According to some embodiments, communications between the player devices 202*a-n* and the game server cluster 210 may be managed and/or facilitated by the load balancer 206. The load balancer 206 may, for example, route communications from player devices 202*a-n* to one or more of the specific game servers 210*a-n* depending upon various attributes and/or variables such as bandwidth availability (e.g., traffic management/volumetric load balancing), server load (e.g., processing load balancing), server functionality (e.g., contextual awareness/availability), and/or player-server history (e.g., session awareness/stickiness). In some embodiments, the load balancer 206 may comprise one or more devices and/or services provided by a third-party (not shown). The load balancer 206 may, for example, comprise an Elastic Load Balancer (ELB) service provided by Amazon® Web Services, LLC of Seattle, Wash. According to some embodiments, such as in the case that the load balancer 206 comprises the ELB or a similar service, the load balancer 206 may manage, set, determine, define, and/or otherwise influence the number of game servers 210*a-n* within the game server cluster 210. In the case that traffic and/or requests from the player devices 202*a-n* only require the first and second game servers 210*a-b*, for example, all other game servers 210*c-n* may be taken off-line, may not be initiated and/or called, and/or may otherwise not be required and/or utilized in the system 200. As demand increases (and/or if performance, security, and/or other issues cause one or more of the first and second game servers 210*a-b* to experience detrimental issues), the load balancer 206 may call and/or bring online one or more of the other game servers 210*c-n* depicted in FIG. 2. In the case that each game server 210*a-n* comprises an instance of an Amazon® Elastic Compute Cloud (EC2) service, the load balancer 206 may add or remove instances as is or becomes practicable and/or desirable.

In some embodiments, the load balancer 206 and/or the Internet 204 may comprise one or more proxy servers and/or devices (not shown in FIG. 2) via which communications between the player devices 202*a-n* and the game server cluster 210 are conducted and/or routed. Such proxy servers and/or devices may comprise one or more regional game hosting centers, for example, which may be geographically dispersed and addressable by player devices 202*a-n* in a given geographic proximity. In some embodiments, the proxy servers and/or devices may be located in one or more geographic areas and/or jurisdictions while the game server cluster 210 (and/or certain game servers 210*a-n* and/or groups of game servers 210*a-n* thereof) is located in a separate and/or remote geographic area and/or jurisdiction.

According to some embodiments, for specific game types such as a game including both a first aspect (e.g., determining regular symbols to appear along paylines, as outcomes, for a game instance of the primary game) and a second aspect (e.g., determining which positions, if any, on an interface of the primary game should have bonus round symbols placed thereon for a game instance of the primary game) as described herein, the game server cluster 210 may provide game outcomes (such as a first outcome for a primary aspect of a game or a second outcome for a bonus round of game) to a controller device (not separately shown in FIG. 2) that times the release of game outcome information to the player devices 202*a-n* such as by utilizing a broadcaster device (also not separately shown in FIG. 2) that transmits the time-released game outcomes to the player devices 202*a-n* (e.g., in accordance with the Transmission Control Protocol (TCP) and Internet Protocol (IP) suite of communications protocols (TCP/IP), version 4, as defined by "Transmission Control Protocol" RFC 793 and/or "Internet Protocol" RFC 791, Defense Advance Research Projects Agency (DARPA), published by the Information Sciences Institute, University of Southern California, J. Postel, ed. (September 1981)).

In some embodiments, the game server cluster 210 (and/or one or more of the game servers 210*a-n* thereof) may be in communication with the dynamic DB 240*a*. According to some embodiments, the dynamic DB 240*a* may comprise a dynamically-scalable database service such as the DyanmoDB™ service provided by Amazon® Web Services, LLC. The dynamic DB 240*a* may, for example, store information specific to one or more certain game types (e.g., a reeled slots themed game) provided by the game server cluster 210 such as to allow, permit, and/or facilitate reporting and/or analysis of such information.

According to some embodiments, the game server cluster 210 (and/or one or more of the game servers 210*a-n* thereof) may be in communication with the cloud-based cache cluster 240*b*. Game state information from the game server cluster 210 may be stored in the game state cache 240*b*-1, for example, slot state (e.g., slot-game specific state) data may be stored in the slot state cache 240*b*-2, and/or other game and/or player information (e.g., progressive data, player rankings, audit data) may be stored in the hydra cache 240*b*-3. In some embodiments, the cache persistor 220 may move and/or copy data stored in the cloud-based cache cluster 240*b* to the non-relational DB 240*c*. The non-relational DB 240*c* may, for example, comprise a SimpleDB™ service provided by Amazon® Wed Services, LLC. According to some embodiments, the game server cluster 210 may generally access the cloud-based cache cluster 240*b* as-needed to store and/or retrieve game-related information. The data stored in the cloud-based cache cluster 240*b* may generally comprise a subset of the newest or freshest data, while the cache persistor 220 may archive and/or store or move such data to the non-relational DB 240*c* as it ages and/or becomes less relevant (e.g., once a player logs-off, once a game session and/or tournament ends). The game server cluster 210 may, in accordance with some embodiments, have access to the non-relational DB 240*c* as-needed and/or desired. The game servers 210*a-n* may, for example, be initialized with data from the non-relational DB 240*c* and/or may store and/or retrieve low frequency and/or low priority data via the non-relational DB 240*c*.

In some embodiments, the SQS device 222 may queue and/or otherwise manage requests, messages, events, and/or other tasks or calls to and/or from the server cluster 210. The SQS device 222 may, for example, prioritize and/or route requests between the game server cluster 210 and the task scheduler 224. In some embodiments, the SQS device 222 may provide mini-game and/or tournament information to the server cluster 210. According to some embodiments, the task scheduler 224 may initiate communications with the SQS device 222, the e-mail service provider 226 (e.g., providing e-mail lists), the remote DB service 240*d* (e.g., providing inserts and/or updates), and/or the persistence DB 240*e* (e.g., providing and/or updating game, player, and/or other reporting data), e.g., in accordance with one or more schedules.

According to some embodiments, the persistence DB 240*e* may comprise a data store of live environment game and/or player data. The game server cluster 210 and/or the task scheduler 224 or SQS device 222 may, for example, store game and/or player data to the persistence DB 240*e* and/or may pull and/or retrieve data from the persistence DB 240*e*, as-needed and/or desired. The server cluster 210 may, according to some embodiments, provide and/or retrieve spin and/or other game event info and/or configuration information via the persistence DB 240*e*.

In some embodiments, the reporting DB 240*f* may be created and/or populated based on the persistence DB 240*e*. On a scheduled and/or other basis, for example, a data transformation and/or mapping program may be utilized to pull data from the live environment (e.g., the persistence DB 240*e*) into the reporting DB 240*f*. The query service 228 may then be utilized, for example, to query the reporting DB 240*f*, without taxing the live environment and/or production system directly accessible by the game server cluster 210.

Figure 3:
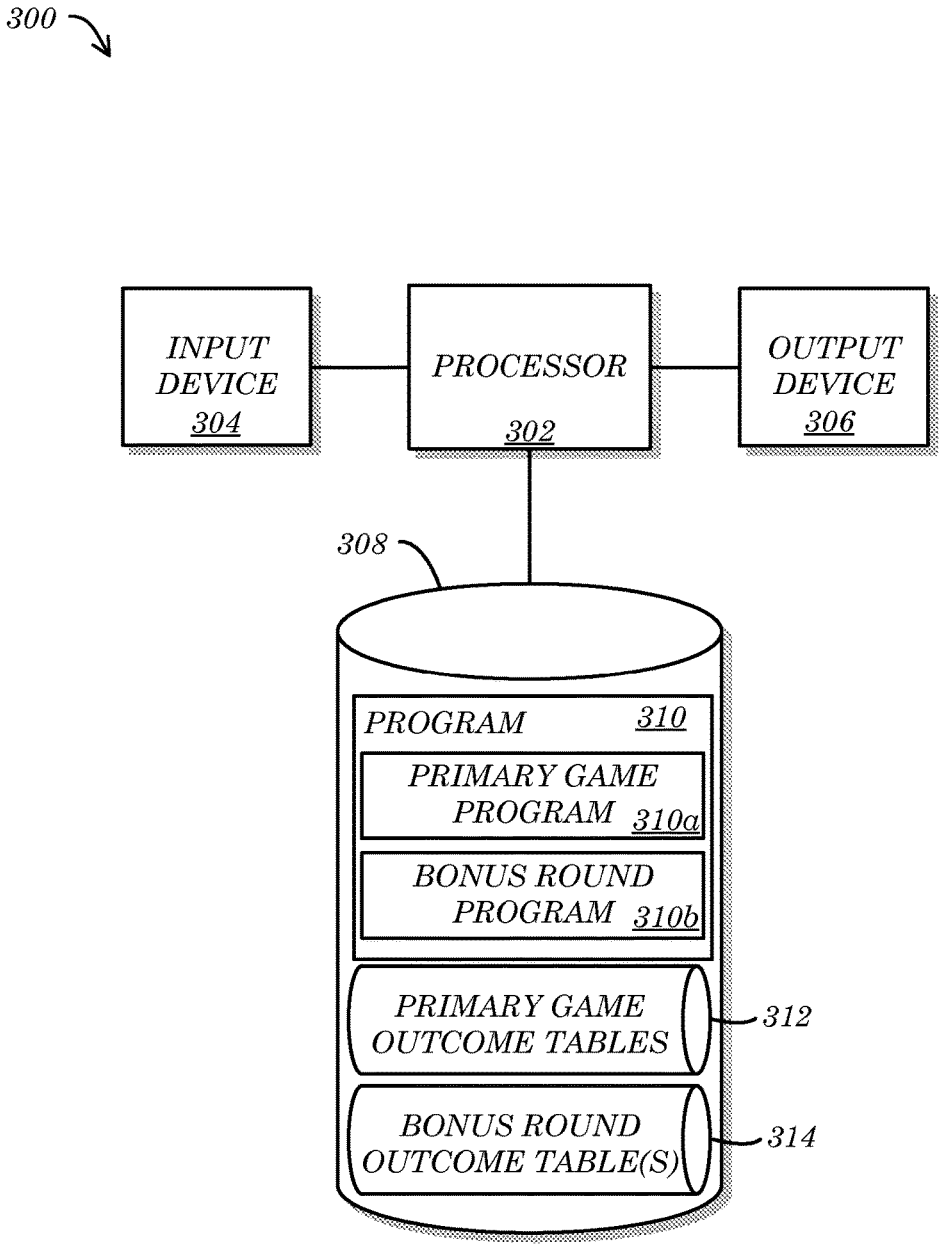
FIG. 3 is a block diagram of an embodiment of a computing device useful in a system according to one or more embodiments described herein.

FIG. 3 is a block diagram of an apparatus 300 according to some embodiments. In some embodiments, the apparatus 300 may be similar in configuration and/or functionality to any of the player devices 102, the game server 110 and/or another server device operable to facilitate the embodiments described herein. The apparatus 300 may, for example, execute, process, facilitate, and/or otherwise be associated with any of the processes 700 and/or 800 described herein in conjunction with FIG. 7 and FIG. 8, respectively.

In some embodiments, the apparatus 300 may comprise a processor 302, an input device 304, an output device 306 and/or a memory device 308. Fewer or more components and/or various configurations of the components 302, 304, 306 and/or 308 may be included in the apparatus 300 without deviating from the scope of embodiments described herein.

According to some embodiments, the processor 302 may be or include any type, quantity, and/or configuration of processor that is or becomes known. The processor 302 may comprise, for example, an Intel® IXP 2800 network processor or an Intel® XEON™ Processor coupled with an Intel® E7501 chipset. In some embodiments, the processor 302 may comprise multiple interconnected processors, microprocessors, and/or micro-engines. According to some embodiments, the processor 302 (and/or the apparatus 300 and/or other components thereof) may be supplied power via a power supply (not shown) such as a battery, an Alternating Current (AC) source, a Direct Current (DC) source, an AC/DC adapter, solar cells, and/or an inertial generator. In the case that the apparatus 302 comprises a server such as a blade server, necessary power may be supplied via a standard AC outlet, power strip, surge protector, and/or Uninterruptible Power Supply (UPS) device.

In some embodiments, the input device 304 and/or the output device 306 are communicatively coupled to the processor 302 (e.g., via wired and/or wireless connections and/or pathways) and they may generally comprise any types or configurations of input and output components and/or devices that are or become known, respectively.

The input device 304 may comprise, for example, a keyboard that allows an operator of the apparatus 300 to interface with the apparatus 200 (e.g., by a player, an employee or other worker affiliated with either an online casino or other entity operating a system which provides games to players). In some embodiments, the input device 304 may comprise a mechanism configured to indicate to a remote server device an initiation or triggering of an event instance (e.g., that a player has actuated a "reel spin" mechanism and thus initiated a new spin of a reels-based game), such information being provided to the apparatus 300 and/or the processor 302. In such embodiments, the input device may comprise a key on a keyboard of the apparatus 300. Other examples of input devices include, but are not limited to: a game controller and/or gamepad, a bar-code scanner, a magnetic stripe reader, a pointing device (e.g., a computer mouse, touchpad, and/or trackball), a point-of-sale terminal keypad, a touch-screen, a microphone, an infrared sensor, a sonic ranger, a computer port, a video camera, a motion detector, a digital camera, a network card, a Universal Serial Bus (USB) port, a GPS receiver, a Radio Frequency Identification (RFID) receiver, a RF receiver, a thermometer, a pressure sensor, and a weight scale or mass balance.

The output device 306 may, according to some embodiments, comprise a display screen and/or other practicable output component and/or device that is operable to output information. The output device 306 may, for example, comprise a display screen via which are output instructions, guidance, questions or information to a player of an online game. For example, the output device may output a game interface for a bonus round which indicates both a first outcome and a second outcome of a given event instance of the bonus round, such as the symbol position for a game character and an outcome of reels, both of which contribute to determining whether the event instance results in a prize being provided to a player. Some additional examples of output devices that may be useful in some embodiments include a Cathode Ray Tube (CRT) monitor, a Liquid Crystal Display (LCD) screen, a Light Emitting Diode (LED) screen, a printer, an audio speaker, an Infra-red Radiation (IR) transmitter, an RF transmitter, and/or a data port. According to some embodiments, the input device 304 and/or the output device 306 may comprise and/or be embodied in a single device such as a touch-screen monitor.

In some embodiments, the apparatus 300 may comprise any type or configuration of communication device (not shown) that is or becomes known or practicable. For example, the apparatus 300 may include a communication device such as a NIC, a telephonic device, a cellular network device, a router, a hub, a modem, and/or a communications port or cable. In some embodiments, the communication device may be coupled to provide data to a telecommunications device. The communication device may, for example, comprise a cellular telephone network transmission device that sends signals (e.g., an initiation of an event instance) to a server (e.g., game server 110) in communication with a plurality of player devices 102. According to some embodiments, the communication device may also or alternatively be coupled to the processor 302. In some embodiments, the communication device may comprise an IR, RF, Bluetooth™, and/or Wi-Fi® network device coupled to facilitate communications between the processor 202 and another device.

The memory device 308 may comprise any appropriate information storage device that is or becomes known or available, including, but not limited to, units and/or combinations of magnetic storage devices (e.g., a hard disk drive), optical storage devices, and/or semiconductor memory devices such as Random Access Memory (RAM) devices, Read Only Memory (ROM) devices, Single Data Rate Random Access Memory (SDR-RAM), Double Data Rate Random Access Memory (DDR-RAM), and/or Programmable Read Only Memory (PROM).

The memory device 308 may, according to some embodiments, store a program 310 for facilitating one or more of the embodiments described herein, which program may include a primary game program 310*a* for facilitating a primary aspect of a game and a bonus round program 310*b* for facilitating a bonus round of the game. In some embodiments, the primary game program 310*a* and/or the bonus round program 310*b* may be utilized by the processor 302 to provide output information via the output device 306.

The primary game program 310*a* may, for example, provide instructions (i) for determining an outcome comprising regular reels for the primary game, (ii) for determining which symbol positions (e.g., reel positions) should be populated with a respective bonus round symbol; and/or (iii) for determining whether a game event which qualifies the player for entry into the bonus round has been achieved. With respect to (ii), Applicants note that in some embodiments each symbol position of the primary game interface (e.g., each symbol position of each reel in a reeled slot machine themed game) may have associated therewith a respective probability of having a collectible bonus round symbol be placed thereon. In some embodiments, all symbol positions may be weighted the same (i.e., probability of a collectible bonus round symbol appearing in the symbol position may be the same for each symbol position) while in other embodiments different symbol positions may be weighted differently and/or such a probability for one or more of the available symbol positions may be modified as a session progresses. For example, it may become more likely that a bonus round symbol appears on one or more symbol positions after X many game instances of a bonus round, after X many game instances in which a bonus round symbol did not appear, after the player has collected Y many bonus round symbols, etc.

In some embodiments, different types of bonus round symbols may be collected and used in a bonus round (e.g., in a MONOPOLY™-themed game, a player may be able to collect Houses, Railroads and Utilities). In such embodiments, the different types of bonus round symbols may have associated therewith distinct rules or restrictions for use (e.g., a player may only place Railroad bonus round symbols on Railroad properties in a MONOPOLY™ themed game, certain types of bonus round symbols may be saved for use in another bonus round rather than being used in the first bonus round in which they are available for a player's use, certain types of bonus round symbols may be re-used by a player in more than one bonus round), distinct benefits (e.g., some bonus round symbols may qualify the player for additional benefits beyond those of other bonus round symbols when placed on a game interface of a bonus round) and/or may have distinct functionalities associated therewith (e.g., certain types of bonus round symbols may trigger entry into a bonus round). In some embodiments, a bonus round symbol may have an expiration or invalidation associated therewith (e.g., a bonus round symbol may expire or become invalid after it is placed by a player on a bonus round position in a bonus round, after it is placed by a player in a predetermined plurality of bonus rounds, after it has been unused by the player for a predetermined amount of time or instances of the primary game or bonus rounds of the game, etc.). Different types of expiration or invalidation conditions may be associated with different types of bonus round symbols in some embodiments.

In some embodiments, primary game program 310*a* may further cause a determination of which type of bonus round symbol to output on which available symbol position of the primary game interface. With respect to (iii), in some embodiments certain types of special symbols (e.g., certain scatter-type symbols) may cause a bonus round to be initiated if they appear on the game interface, along an active payline of the primary game interface and/or in a minimum quantity for a given game instance. Accordingly, the primary game program 310*a* may cause a processor to determine which, how many, or where bonus round triggering symbols should be output for a game instance of a primary game.

The bonus round program 310*b* may provide instructions which, when executed by a processor, cause the processor to (i) determine which available symbol positions have been selected by a player for a current session of the bonus round; (ii) determine a wager amount (or effective wager amount) to utilize during the bonus round based on one or more factors such as one or more wagers placed by the player during play of the primary game; (iii) determine an active symbol position for a game instance of the bonus round (e.g., where to place a game character or other element the placement/position of which indicates an active position); (iv) determine an outcome for the game instance of the bonus round (e.g., the payout, if any); and (v) determine a final value of a prize (e.g., a payout) to output to a player based on placement of the bonus round symbols of the player and the outcome.

Applicants note that both the primary game program 310*a* and the bonus round program 310*b* have been described herein as including, in at least some embodiments, a determination of two different types of outcomes for two different aspects of each mode of the game. For example, in accordance with some embodiments the primary game may be considered to have two aspects for each of which an outcome needs to be determined in a given game instance: the outcome of the primary game consisting of the regular symbols (e.g., does the player win a payout for a spin of the primary game?) and a placement (if any) of bonus game symbols (and perhaps the type of bonus round symbol) on any given symbol position (e.g., does the player win any collectible bonus round symbols as a result of the current spin? Which ones?). Thus, in some embodiments two distinct probability tables may be accessed for a given game instance to determine each of these respective outcomes for the distinct aspects of the game instance (e.g., a first probability table for determining the outcome of the primary game and a second probability table for determining bonus round symbols to be output to the player). Similarly, in some embodiments the bonus round mode of the game may be considered to have two aspects for each of which an outcome needs to be determined in a given game instance: the determination of a symbol position onto which the game element or game character is to be placed for a given game instance (e.g., where should Mr. MONOPOLY™ go next?) and the determination of a reel-based outcome (e.g., is the spin a winning spin so that player wins a payout?). Thus, as described with respect to the two different aspects of a primary game available in some embodiments, for a bonus round having two different aspects two distinct probability tables may be accessed for a given game instance of the bonus round (e.g., a first probability table to determine the placement of the game character or element which determines an active symbol position and a second probability table for determining an outcome or a default payout (or other prize) for the game instance). Applicants have described, in the context of another type of game and invention(s) the concept of a determining two different outcomes for two distinct aspects of a game, one outcome for each respective aspect of the game (and in some embodiments using two different probability tables for the single game instance, one for each aspect) in co-pending U.S. patent application Ser. No. 13/543,458, filed on Jul. 6, 2012 in the name of Elias et al. and entitled SYSTEMS AND METHODS FOR DETERMINING AND OUTPUTTING OUTCOMES FOR AN EVENT INSTANCE OF A GAME. The entirety of this application, and particularly the description of determining two outcomes for a single game instance or event instance of a game (and, in some embodiments, utilizing two distinct probability tables to determine such outcomes), is incorporated by reference herein for all purposes.

Returning again to the description of memory device 308, in some embodiments such memory device 308 may further store a primary game outcome table(s) 312 and/or a bonus round outcome table(s) 314. In accordance with some embodiments, such tables 312 and/or 314 may comprise respective probability tables and/or payout tables for determining an outcome for an aspect of the game. For example, primary game outcome table(s) may comprise one or more probability and/or payout tables for determining (i) primary game symbols for a first aspect of a primary game, (ii) a payout for the first aspect of the primary game; (iii) the position(s) of, number and type of bonus round symbol(s) to be output to the player for a given game instance of the primary game; and (iv) whether a bonus round should be triggered as a result of the current game instance of the primary game. In another example, the bonus round outcome table(s) may comprise one or more probability and/or payout tables for determining, for a given game instance of a bonus round of the game: (i) an active position for the game instance; and (ii) an outcome for the game instance (e.g., a default value for a prize).

With respect to (i) for the bonus round outcome table(s) 314, Applicants note that in some embodiments the probability of which position is determined to be an active position may include determining how many game instances or other game events have occurred since the beginning of a current session of the bonus round. In accordance with some embodiments, the probability of a particular symbol position being determined for the game element or game character which determined an active position for the game instance (or determined an end to the bonus round) may be dependent on how many game instances of the bonus round have already been resolved. In a particular and non-limiting example, assuming in the MONOPOLY™-themed game that the bonus round ends when Mr. MONOPOLY™ "goes to jail" (i.e., the game character is placed in the "jail" symbol position, which position may not be available to a player for placement of bonus round elements but which may nevertheless be available as an active position), the probability of Mr. MONOPOLY™ being moved to the "jail" position may be increased as the bonus round progresses (e.g., first 3 spins all symbol positions are equally likely to be selected as active positions, $4^{th}$ spin and on the probability of the "jail" position is increased).

The apparatus 300 may function as a computer terminal and/or server of an online casino or other entity operating to provide online games, receive and/or manage information related to online games. In some embodiments, the apparatus 300 may comprise a web server and/or other server device operable to accept wagers and determine random numbers based upon which outcomes for wagering games are determined. In some embodiments, the apparatus 300 may comprise an apparatus that is operable to interact with a player of an online game. In some embodiments, apparatus 300 may comprise a plurality of devices working together to accomplish the functionality described herein with respect to FIG. 3.

Any or all of the exemplary instructions and data types described herein and other practicable types of data may be stored in any number, type, and/or configuration of memory devices that is or becomes known. The memory device 308 may, for example, comprise one or more data tables or files, databases, table spaces, registers, and/or other storage structures. In some embodiments, multiple databases and/or storage structures (and/or multiple memory devices 308) may be utilized to store information associated with the apparatus 300. According to some embodiments, the memory device 308 may be incorporated into and/or otherwise coupled to the apparatus 300 (e.g., as shown) or may simply be accessible to the apparatus 200 (e.g., externally located and/or situated).

Figure 4:
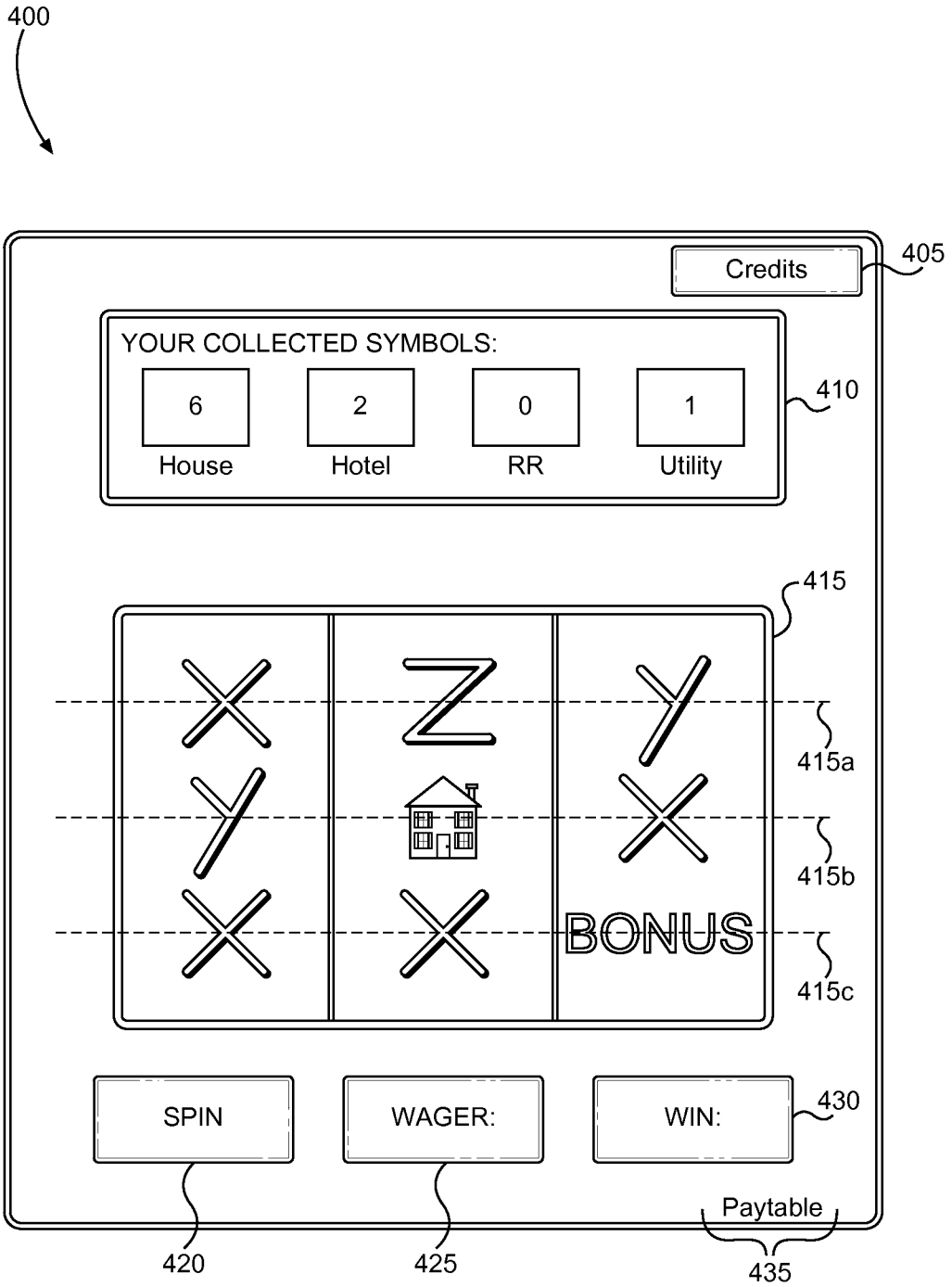
FIG. 4 is an illustration of one example embodiment of a game interface (e.g., a screen shot of an online game) of a primary game in which a player may obtain bonus symbols usable in a bonus round of the game in a manner consistent with one or more embodiments described herein.
Figure 5:
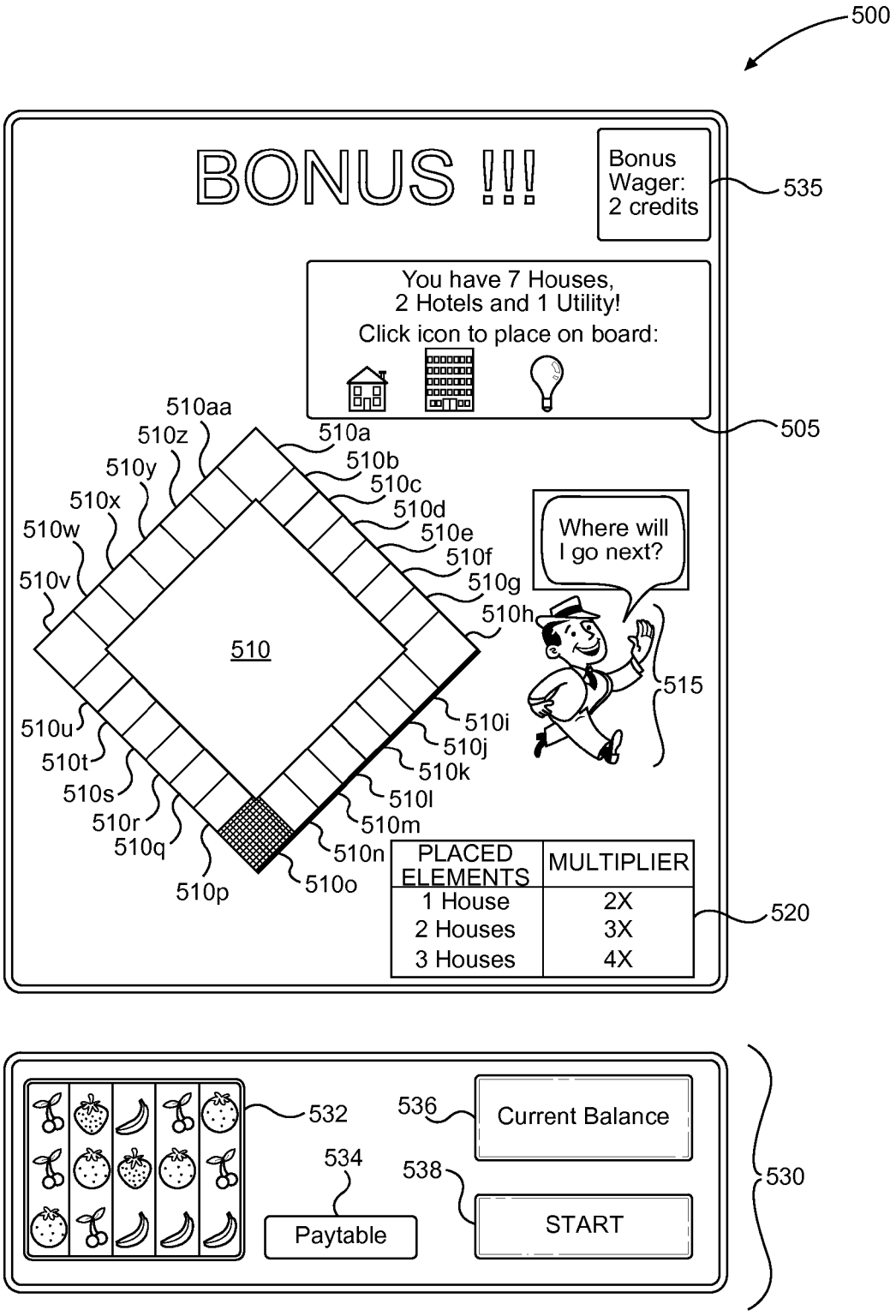
FIG. 5 is an illustration of one example embodiment of a game interface (e.g., a screen shot of an online game) of a bonus round of the primary game illustrated in FIG. 4, in which a player may place bonus game symbols in a manner which affects the volatility of the bonus round.

Turning now to FIGS. 4 and 5, illustrated therein are respective example game interfaces for a MONOPOLY™ themed game which embodies some embodiments described herein. FIG. 4 illustrates an example game interface for a primary aspect of the game while FIG. 5 illustrates an example game interface for a bonus round of the game.

The interface 400 of FIG. 4 comprises a plurality of areas for outputting various information to a player and/or enabling certain functionality or inputs from a player. For example, area 405 is for indicating to a player a number of credits, value or currency available to the player for making wagers in the primary game. Area 410 is for outputting to the player the number of each type of bonus round symbol collected by the player thus far in a current session of the primary game (e.g., since the initiation of the primary game by the player or since the end of a previous bonus round participated in by the player, since the bonus round symbols may be reset after each bonus round). Area 415 is for outputting to the player outcomes of the primary game (e.g. a player may win a payout if a winning combination of regular symbols appears, at the resolution of the game instance or stopping of the reels for a current spin in a reeled slot machine type game, along one or more of the paylines 415*a* through 415*c*). In accordance with some embodiments, any bonus round symbols won by a player as a result of a game instance of the primary game are first output in the area 415 of the game interface (e.g., each bonus round symbol overlaid onto a respective regular symbol in a given symbol position) and then, after initial resolution of the reels or symbol positions for the primary game, moved to the area 410.

In one embodiment, in a primary game the regular game symbols are output on the reels in area 415 and any bonus round symbols won by the player as a result of the spin initially cover up or obscure the regular game symbols when the reels first stop spinning. The bonus round symbols are then animated or otherwise shown to move from covering the regular game symbols (thus revealing the regular game symbols or unobscuring these) and moved to another area (e.g., area 410 of FIG. 4) of the game interface (e.g., an area for outputting to the player the type and number of bonus round symbols collected thus far and usable in the next bonus round). Co-pending patent application Ser. No. 13/543,458, previously incorporated by reference herein, describes various methodologies for how symbols for a first aspect of a game may be overlaid or otherwise output along with symbols for a second aspect of the game and then moved to a different area of the game interface (such description of application Ser. No. 13/543,458 being particularly incorporated by reference herein).

The game interface 400 further includes additional areas 420 (e.g., for allowing a player to initiate a spin or game instance of the primary game), 425 (e.g., for allowing a player to indicate a value of a wager for a current spin and/or outputting to the player the value of the wager being used for the current game instance), area 430 (e.g., for indicating to a player a value of a payout or other prize won as a result of the current game instance) and area 435 (e.g., for allowing a player to access a paytable being utilized for the game). Of course, other areas or information may be output to a player and/or some of this information may be omitted. For example, in accordance with some embodiments a wager or effective wager for a bonus round (e.g., to determine a payout table or portion of a payout table to access to determine default values of prizes won by the player during game instances of the bonus round) may be determined based on wagers made by the player in the primary game prior to entering the bonus round. In one example, the average wager of the primary game in the current session may be used. In another example, the average of the last X wagers (e.g., the last 10 wagers) may be used. In yet other embodiments, other information associated with the player may be used to determine an effective wager amount for the bonus round, such as a player profile or rating, average wager over multiple sessions or games, benefits obtained by the player in one or more games, whether it's the player's birthday today, etc. In such embodiments, an area of the game interface 400 may indicate the current effective wager (e.g., based on the players wagers or other activity during the primary game) to be used for the next bonus round, once it is triggered, may be output.

Turning now to FIG. 5, illustrated therein is an example game interface which may be output to a player once the player qualifies for entry into a bonus round (e.g., based on a particular symbol or other game event being achieved by the player in the primary game). As described with respect to FIG. 4, in accordance with one embodiment and as one non-limiting example, a MONOPOLY™-themed game is provided in which, during the primary aspect of the game, a player plays a reeled slot machine game in which bonus round symbols comprising MONOPOLY™-themed elements may be collected (e.g., houses, hotels, utility companies, railroads). Continuing with this theme into the example of FIG. 5, once a player enters a bonus round of the game (e.g., based on an outcome of reels of the slot machine game or other qualifying event), the player is provided with a MONOPOLY™ board interface which includes various properties on which Mr. MONOPOLY™ may land based on a roll of virtual dice. In one embodiment, upon a player initiating a game instance of the bonus round (e.g., by actuating a "start" button or mechanism for the bonus round), a roll of the virtual dice determines the symbol position (e.g., property) to which Mr. MONOPOLY™ is to move for the current game instance. In accordance with some embodiments, bonus round may further comprise a second aspect in which a second outcome is determined based on a spin of reels. In accordance with some embodiments, the second outcome may contribute towards determining whether the current game instance is a winning one in that if the symbols along a payline of the reels correspond to a winning symbol combination (and Mr. MONOPOLY™ lands on a property on which the player placed one or more bonus round symbols), a payout or other prize may be due to a player but if the symbols on the payline of the reels do not correspond to a winning combination, a payout or other prize may not be due to the player. In accordance with some embodiments, the outcome of the roll of the dice (comprising an outcome of a first aspect of the bonus round) may resolve prior to a resolution of reels (comprising an outcome of a second aspect of the bonus round).

In some embodiments, the movement of the Mr. MONOPOLY™ game character may be controlled by a random or pseudo-random algorithm and using a probability table of available symbol positions or properties). In one embodiment, each property may be associated with a base payout (i.e., a prize having a default value) or "rent." In other embodiments, a base payout may be determined (e.g., based on a spin of a reel aspect of the bonus round) for each event instance of the bonus round and applied to the particular property or symbol position on which Mr. MONOPOLY™ is currently placed. The based payout (in some circumstances increased or enhanced based on the number of bonus round symbols placed by the player on a property or symbol position, as explained herein) may be awarded to the player if Mr. MONOPOLY™ lands on that property and that property "belongs" to the player during that bonus round because the player has placed at least one bonus round symbol (previously collected during the primary aspect of the game) on that property.

Thus, turning again to FIG. 5, illustrated therein is an example game interface 500 comprising a plurality of areas for outputting various information to a player and/or enabling certain functionality or inputs from a player. For example, area 505 indicates to the player which bonus round symbols, and how many of each, the player has accumulated during play of the primary game and thus has available for placement in the bonus round. It should be noted that the types of symbols illustrated in area 505 are exemplary only and not all (or any) of such symbols need by utilized in all embodiments or even in Monopoly™-themed embodiments. For example, in some embodiments, "hotels" may not be a type of symbol which may be accumulated or won by a player in the primary game. It should further be noted that in some embodiments, a player need not use all (or any) of the symbols indicated as available for the player's use in area 505. For example, in some embodiments the symbols indicated in area 505 are available for the player's use in a current bonus round but the player may choose to not use some (or any) of these symbols in a current bonus round (e.g., instead saving such bonus round symbols in a subsequent bonus round). It should be noted that, in accordance with some embodiments, the bonus round symbols indicated in area 505 as being available for the player's use in a current bonus round may have been accumulated over one or more sessions of a primary game or may include bonus round symbols accumulated by the player prior to a previous bonus round but not utilized by the player in the previous bonus round. For example, in some embodiments, bonus round symbols collected by a player during play of a primary game persist as available for the player's use indefinitely, over the course of a plurality of bonus rounds, for a predetermined period of time or for a predetermined period of bonus rounds, etc. In other embodiments, any bonus round symbols accumulated by a player and available to the player for use upon an initiation of a particular bonus round are no longer available (e.g., expire or become invalid) if not used by the player in the current bonus round. In some embodiments, a player may provide a payment or other consideration in exchange for being able to save one or more bonus round symbols for use in a subsequent bonus round. In some embodiments, certain types of bonus round symbols may be saved for use in a subsequent bonus round while other types of bonus round symbol may only be valid for the bonus round in which they are first available for the player's use. In still other embodiments, certain types of bonus round symbols may be used in more than one bonus round (e.g., a certain bonus round symbol may be re-used in two or more bonus rounds before it expires or becomes invalid).

Areas 510*a*-510*aa* comprise available symbol positions. In accordance with some embodiments, some of the available symbol positions may comprise positions onto which a game character or other game element (e.g., such as the game character 515) may be placed in accordance with a first aspect of the bonus round, which placement is done based on a random or pseudo-random algorithm and using one or more probability tables. In some embodiments, one or more of the available symbol positions may not be available for a player to place bonus round symbols upon (e.g., symbol position 510*o* is such a position, such as the "jail" position in the MONOPOLY™-themed game). In some embodiments, some symbol positions may have certain restrictions associated therewith, such as being limited in the types of bonus round symbols which may be placed thereon (e.g., "railroad" symbol positions may only accept "railroad" bonus round symbols, "utility" symbol positions may only accept "utility" bonus round symbols, etc.).

In accordance with some embodiments, the player selects one or more symbol positions or properties 510*a*-510*aa* (other than symbol position 510*o*) and places one or more bonus round symbols (as indicated in area 505) thereon. For example, the player may place one or more houses on some properties (e.g., designating these properties as "belonging" to the player for purposes of the bonus round, such selected properties also referred to as "player selected" symbol positions herein), which railroad(s) the player "owns" for the bonus round (e.g., if the player collected two railroad elements during the primary game, the player may select which 2 of the available 4 railroads on the board the player wants to "own" for the duration of the bonus round, again such a selected railroad may be considered a player selected symbol position in accordance with some embodiments herein).

In accordance with some embodiments, if a particular symbol position is determined to be an active symbol position (e.g., the game character 515 is placed thereupon) and is further determined to be a player selected symbol position, certain benefits may be provided to the player. For example, in accordance with some embodiments, if a player selected symbol position turns out to be an active symbol position for a given game instance, the default prize value (e.g., payout) may be increased based on the number of bonus round elements the player placed therein. Area 520 of game interface 500 indicates that, in some embodiments, such an increase may be based on a multiplier to be applied to the default prize value. In the particular example of FIG. 5 and with respect to placement of the house elements, in accordance with some embodiments if the player places one or more house elements on a particular property, a multiplier is applied to the base payout for that property if Mr. MONOPOLY™ lands on the property. For example, if the player placed 3 houses on the "Boardwalk" property and the base payout for the "Boardwalk" property is 100 credits, a multiplier of 4× may be applied in some embodiments, such that if Mr. MONOPOLY™ lands on the "Boardwalk" property during the round of the game, 400 credits may be awarded to the player.

In accordance with other embodiments, placement of a single bonus round symbol (e.g., a house or other type of bonus round game symbol in the MONOPOLY™-themed game of the present example) may not cause a multiplier to be applied to any resultant payout, but one or more other benefits may apply to the player if the symbol position on which the player placed the single house or other bonus round symbol is determined to be an active symbol position. For example, in some embodiments the benefit may comprise maintaining the symbol position as an active symbol position until an outcome corresponding to a payout greater than zero (or some other predetermined minimum value) is determined for a game instance. As described herein, in some embodiments each game instance of a bonus round comprises a determination of two respective outcomes, one for each aspect of the bonus round game instance. A first outcome is the determination of the active position (this is, in some embodiments and claims, not referred to as an outcome but rather a determination of an active position for the game instance, for purposes of simplifying the explanation of the process). A second outcome is the determination of whether a payout or other prize corresponds to the event instance (e.g., spinning virtual reels of a reel-themed component of the bonus round and determining whether the outcome of the reels corresponds to a payout; this latter outcome for the second aspect of the bonus round is referred to as the outcome for the bonus round). Thus, in some embodiments, even if the game element (e.g., Mr. MONOPOLY™ in the MONOPOLY™-themed game) placement results in a determination that the active position is a player selected position, if the outcome determined (i.e., the outcome determined for the second aspect of the bonus round) does not correspond to a payout (i.e., the outcome is a non-winning combination of symbols along each payline), the player may not win a payout or other prize as a result of the game instance and the bonus round may progress to the next game instance, in which a new active position and new outcome are determined. However, in other embodiments, if an active position is determined to be a player selected position and the outcome determined for the second aspect of the bonus round is not a winning outcome (or, in some embodiments, the payout or other prize is not of at least a minimum magnitude even though that value is greater than zero), the active position may be maintained for one or more subsequent game instances of the bonus round (e.g., Mr. MONOPOLY™ does not move for the one or more game instances) until a winning outcome or an outcome of at least a predetermined minimum value is determined (e.g., the reels are re-spun until the player wins some minimum prize for his selected property. In such embodiments, even if a multiplier is not applied or the prize value otherwise increased when a player has placed only a single bonus round symbol on a player selected symbol position, the player may still receive a benefit as a result of having so placed the bonus round symbol due to the fact that the active symbol position is maintained until the player wins a prize. In other embodiments, the active position may be maintained not until the player wins a prize but until an occurrence of some other terminating condition (e.g., for the 3 next game instances or outcomes).

Turning again the game interface 500, the reels in area 532 comprise one manner in which an outcome for a second aspect of a bonus round may be output to a player. For example, an outcome for the reels may be determined (e.g., using a random or pseudo-random number algorithm) and the reels may be spun and stopped to show, along one or more paylines (not shown in area 532) a combination of symbols which correspond to a payout. Thus, in the embodiments described above in which an active position is maintained until a termination condition is reached (e.g., until a winning outcome is determined for the active position), the reels in area 532 may be re-spun (and a new random or pseudo-random number determined for use in determining the outcome displayed on the reels once they resolve) until the termination condition is reached.

As can be appreciated from the above description, in some embodiments, a default value of a prize (e.g., a payout amount) may vary (e.g., based on random results of a reel-based aspect of the game) for a given property or symbol position during the bonus round. Thus, for example, once Mr. Monopoly™ lands on a particular property (e.g., based on a roll of the dice), a base payout for that property may be determined (e.g., randomly such as by a random number generator or by otherwise selecting one of a plurality of possible base payout associated with that property). The multiplier (if any) associated with that property as a result of placement of elements (e.g., based on how many house elements the player placed on the property) is then determined and used to calculate the actual payout amount to be awarded to the player (e.g., base payout is multiplied by the multiplier).

Thus, in some embodiments, a selection of an active symbol position (e.g., Mr. MONOPOLY™ moving to a particular symbol position of symbol positions 510*a*-510*aa* as a result of a roll of virtual dice (not shown) or another determination) is but the first condition to the player qualifying for a payout. In such embodiments, while Mr. MONOPOLY™ is on the property a winning result (e.g., winning symbols lined up along a payline) may need to be obtained by the player. In such embodiments, the base payout for the property may either be a payout that remains unchanged for the duration of the bonus round or may vary during the bonus round and be determined based on a resolution of reels or another factor.

The game interface 500 may include other areas (grouped in the lower game interface area 530, which may be further useful for outputting information to a player and/or receiving an input from a player. For example, a link to a paytable (area 534) used to determine a payout corresponding to an outcome shown in area 532 may be provided. A current balance of credits (area 536) may be provided in embodiments in which wagers are deducted from a balance of credits for game instances of the bonus round. A start or other game instance initiation mechanism (area 538) may be provided for allowing a player to indicate when a new game instance is to be initiated.

In accordance with one or more embodiments, a wager or effective wager may be utilized in some embodiments to determine a value of a prize for a game instance of the bonus round (whether such wager or effective wager is deduced from a player's credit balance or even if no wagers are deducted from any credit balance for game instances of a bonus round). For example, in some embodiments a paytable applicable to determining the value of a prize corresponding to an outcome determined for a first game instance of a may have different values for payouts or other prizes as corresponding to a given payout, with the different default values corresponding to a wager or effective wager amount being used. In a particular example, for a given outcome A-A-A available as a winning outcome for an aspect of the bonus round, the corresponding payout may be 10 credits if the effective wager for the game instance is 1 credit, 15 credits if the effective wager for the game instance is 2 credits and 30 credits if the effective wager for the game is 3 credits. Thus, a higher effective wager may, in some embodiments, result in a higher default payout value being won by a player as a result of a particular outcome. A wager or effective wager for a game instance of a bonus round may be, for example, (i) selected by a player; (ii) randomly determined for the player (e.g., for use in a particular game instance or for use over the course of a particular bonus round); or (iii) determined for the player based on past wagering activity or other activity of the player (e.g., wagering activity of the player in the primary game prior to the bonus round being initiated). As described herein, an effective wager amount for a bonus round that is based on past wagering activity or other activity of a player may be determined based on, for example, (i) an average or median wager of the player during play of the primary game (e.g., during the present session, since the last bonus round was ended, in the last X game instances of the primary game prior to initiating the bonus round, etc.) or (ii) a player rating or profile of the player. With respect to (i), it should be noted that if an effective wager is based on the wagers selected by the player in past game instances of the primary game, in some embodiments more recent game instance wagers may be weighted more heavily in determining an effective wager for the bonus round (e.g., in order to motivate the player to maintain a higher wager per game instance of the primary game). Area 535 illustrates one embodiment of how an effective wager for a bonus round may be displayed to the player.

It should be noted that the above-described MONOPOLY™-themed game example is not to be taken in any limiting fashion, as it is provided for illustrative purposes only. Many variations on various aspects of methods and systems for providing a bonus round in accordance with different embodiments are described herein.

Figure 6:
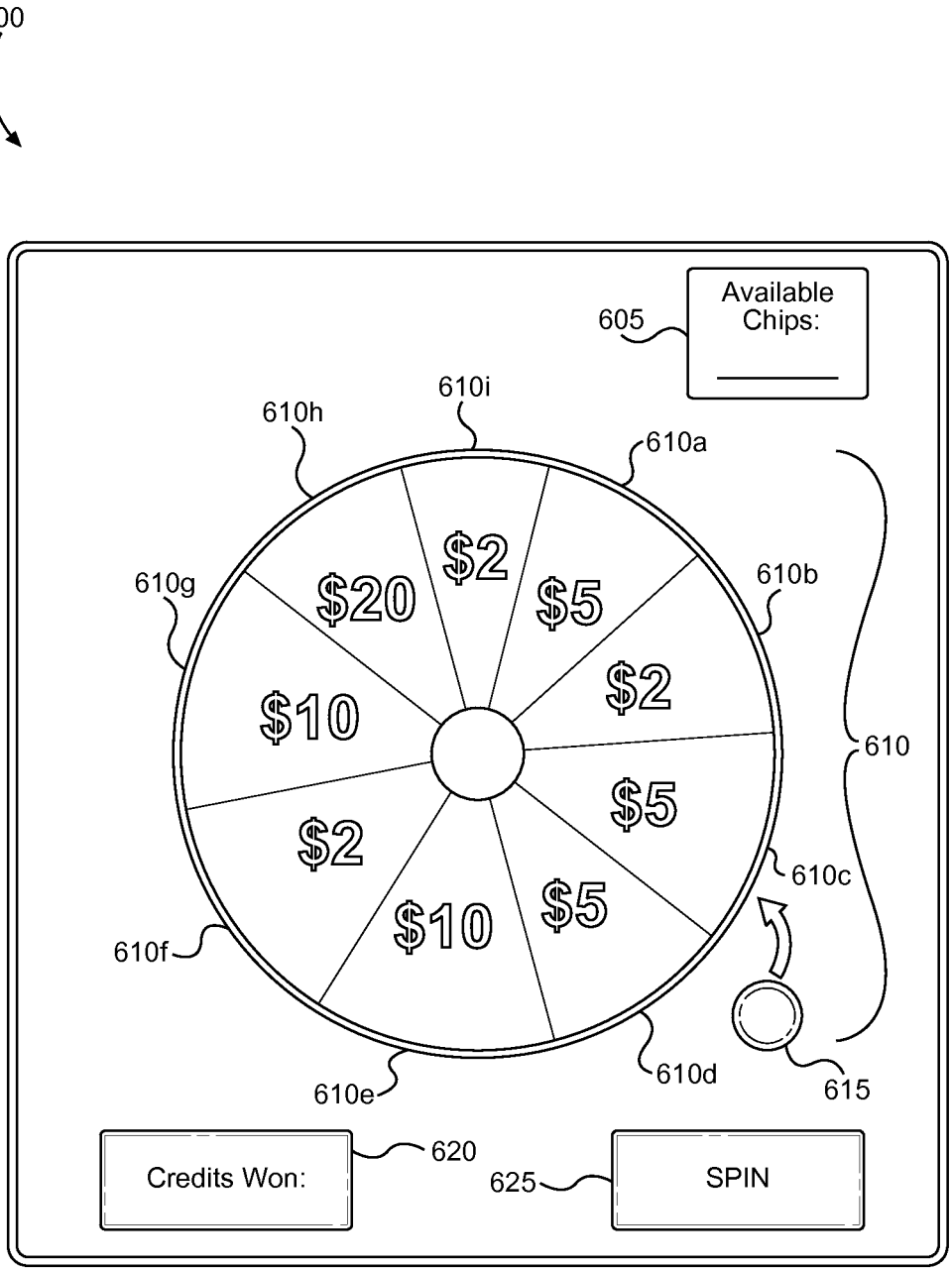
FIG. 6 is an illustration of an example embodiment of a game interface (e.g., a screen shot of an online game) of a bonus round of another type of primary game, in which a player may place bonus game symbols in a manner which affects the volatility of the bonus round.

Turning now to FIG. 6, illustrated therein is an example interface 600 of a bonus round of a game other than a MONOPOLY™-themed game. Further, the interface 600 is for a bonus round in which there is no second aspect utilized in determining whether a player qualifies for a prize. As noted with respect to FIG. 5, in some embodiments a determination of whether a player qualifies for a prize as a result of a game instance of a bonus round may comprise a two-step process in which an active symbol position is first determined and compared to player selected symbol positions and, if the active symbol position is a player selected player position, it must further be determined whether an outcome for a second aspect of the bonus round (e.g., a reeled slot machine themed aspect) corresponds to a payout or other prize. In other embodiments, however, the two-step process may be simplified in that the bonus round may include on each of the symbol positions an indication of a default prize or default value of a prize, such that determination of an active symbol position and determining whether the active symbol position is a player selected symbol position is all that is necessary to determine whether the player wins a prize, since the symbol positions are associated with predetermined prizes. The particular game interface 600 of FIG. 6 is a roulette-themed (or other spinning wheel-themed) game in which the wheel interface 610 comprises a plurality of symbol positions or portions 610*a*-610*i*, each of which corresponds to a predetermined default prize value (illustrated thereon for purposes of the present example). A player may thus place one or more bonus round symbols (which the player has won or otherwise obtained as a result of playing a primary game which the bonus round is a feature of) on any one of the symbol positions 610*a*-610*i*. The number of such bonus round symbols (in the form of virtual "chips" in the present example, illustrated as element 615) available to a player in a current bonus round may be indicated in area 605. As with the embodiments of FIG. 5, different types of bonus round symbols may be won by a player in the primary game and available for use in the bonus round, even though only one type of bonus round symbol is illustrated in area 605. Once the player places one or more bonus round symbols on the available symbol positions, these symbol positions are considered player selected player positions. An active symbol position may then be determined (e.g., based on a random or pseudo-random number) and, if the active symbol position is determined to also be a player selected symbol position, the player is awarded a prize based on (i) the default prize value indicated on the active symbol position; and (ii) any multiplier or other increase in the default prize value due to the player based on the number of bonus round symbols the player has placed on the active symbol position. Many of the other concepts described with respect to other embodiments described herein may also be applicable to embodiments such as that illustrated via interface 600 (i.e., a bonus round that does not comprise two distinct aspects for determining a default value of a prize for a game instance of the bonus round).

Figure 7:
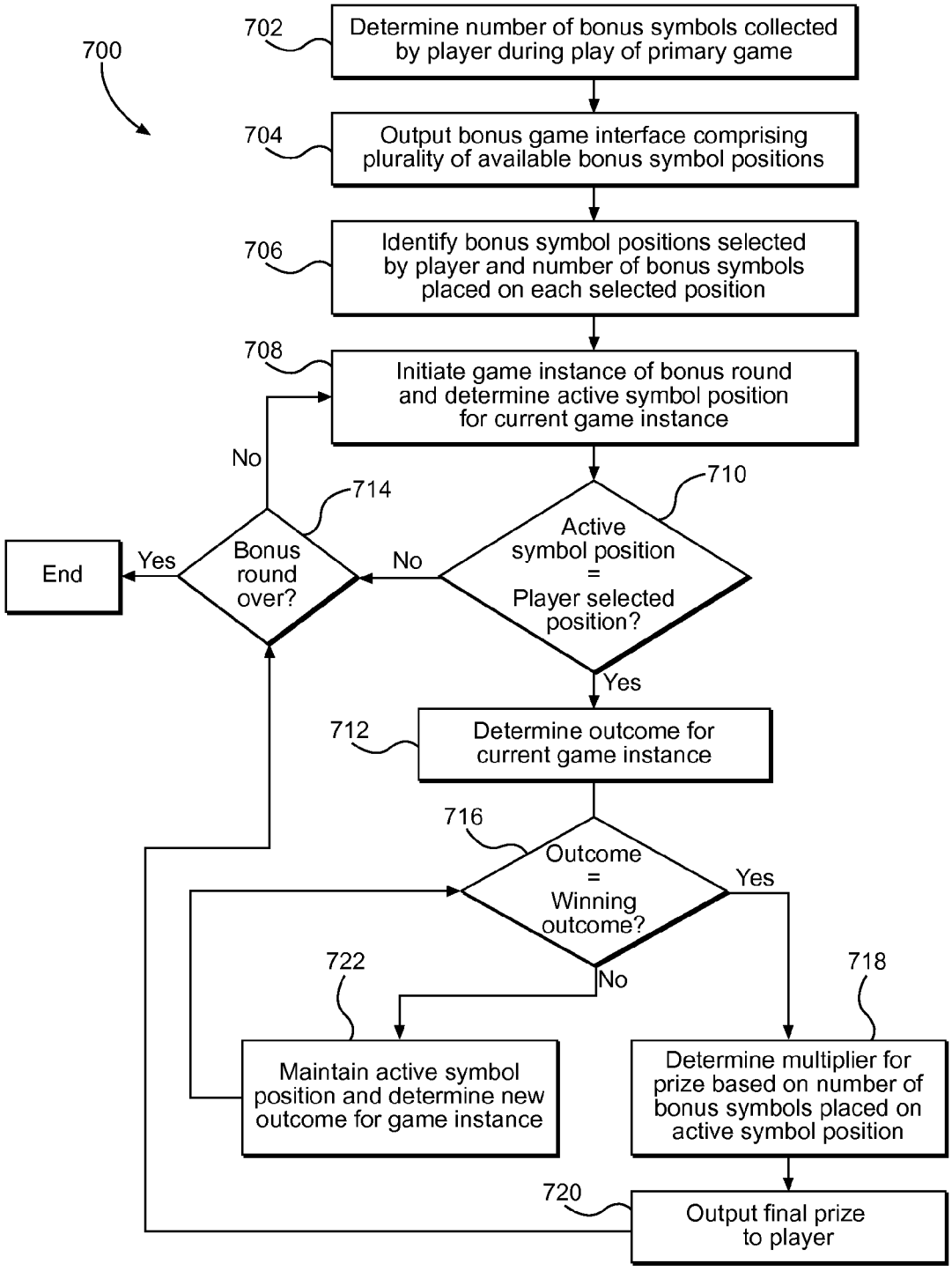
FIG. 7 is a flowchart illustrating a method according to one or more embodiments described herein.

Turning now to FIG. 7, illustrated therein is an example process 700 which is consistent with various embodiments described herein. Process 700 may be performed, for example, by a processor of a server or a player device (e.g., a device 300 of FIG. 3). The process 700 illustrates one method for determining a result of a game instance of a bonus round (e.g., whether a player qualifies for a payout for a particular game instance and, if so, the final value of the payout), wherein the bonus round comprises two distinct aspects: (i) determining an active symbol position; and (ii) determining an outcome for a second aspect of the bonus round to determine a payout, if any, for the active symbol position. In accordance with some embodiments, process 700 may be initiated upon a bonus round being triggered or initiated based on a qualifying event occurring in the primary game.

In step 702 the number of bonus symbols collected by the player in the primary game is determined. In some embodiments involving different types of bonus round symbols, the number of each type of bonus round symbol collected may be determined. In some embodiments, events within the bonus round (or upon the initiation of the bonus round) may also qualify the player for bonus round symbols, which may be added to the number of such symbols determined in step 702. In some embodiments, the bonus symbols available to the player may have been accumulated by the player over multiple sessions or may have been accumulated by the player prior to a previous bonus round and unused by the player in the bonus round and thus remain available for the player's use in the current bonus round.

In step 704 a bonus game interface comprising a plurality of available bonus symbol positions is output to the player (e.g., via a display of a player device 102 associated with the player). For example, an interface such as interface 500 (FIG. 5) or interface 600 (FIG. 6) may be output.

In step 706 the one or more bonus round symbol positions selected by the player is determined (e.g., the positions onto which the player placed one or more bonus round symbols are determined). In accordance with some embodiments, a player may not be able to move the bonus round symbols once they have been placed (or, for example, after some stage or event in the bonus round). Thus, in some embodiments, the positions determined in step 706 may be considered the player selected positions for the duration of the bonus round (or for the remaining duration of the bonus round after the stage or event which cuts off the player's ability to move the bonus round symbol elements The number of bonus round symbols placed on each such position is also determined. In some embodiments, certain symbol positions may have certain restrictions associated therewith. Accordingly, step 706 may comprise verifying that the placement by the player of particular bonus round symbol(s) does not violate any restrictions associated with the symbol position(s) on which the player has attempted to place them (e.g., certain types of bonus round symbols may only be placed on certain types of symbol positions). In the embodiment of FIG. 5, for example, step 706 may comprise determining which positions 510*a* through 510*aa* the player has placed any of his/her bonus round symbols and considering those positions to be player selected positions for purposes of the current bonus round.

As described herein, in some embodiments a player may choose not to place some or any of the bonus symbols available to the player in a current bonus round. In such embodiments, process 700 may further comprise determining whether the player is choosing to not use one or more of the bonus symbols available to the player for the current bonus round. Such a determination may comprise, for example, determining that the player has indicated (s)he is finished placing bonus symbols for the current bonus round yet there are still additional bonus symbols remaining available for the player's use. In another embodiments, a player may need to affirmatively actuate a "save symbol for future use" or other similar mechanic to indicate (s)he is choosing to save one or more particular symbols for use in a future bonus round. In some embodiments, an indication of the type and number of bonus symbols determined to be available to a player for use in a future bonus round (e.g., because the player has chosen not to use them in a future bonus round or because the bonus symbols are re-usable over a plurality of bonus round) may be stored in association with a user in a database or other storage mechanism.

In step 708 a game instance of a bonus round is initiated. For example, it may be determined that a player has actuated a "start" or "spin" or "roll" mechanism of the bonus round, to indicate that a game instance is to be initiated. In accordance with some embodiments, an active symbol position for the game instance is the outcome determined in step 708. For example, the random or pseudo-random number determined in step 708 may be compared to a probability table which illustrates, for each possible random or pseudo-random number (or range of the foregoing) (i) a number of symbol positions a game character is to move forward from a current position on the game interface; (ii) a particular symbol position to be considered the active symbol position; or (iii) another methodology, calculation or scheme for determining an active symbol position.

In the embodiment of FIG. 5, for example, step 708 may comprise determining which of the symbol positions 510*a*-510*aa* the game character 515 is to move to. The symbol position to which the game character 515 is moved to is considered the active position for the current game instance in accordance with some embodiments. In one example embodiment, a virtual roll of virtual dice may be used to reveal the active symbol position for the current game instance by indicating via the dice the number of symbol positions the game character is to move from its current position. The number to be shown on the dice may be determined using a pseudo-random number and an appropriate probability table. The game character 515 may then be moved the appropriate number of symbol positions forward until it is placed (or a representation of its placement is indicated) on the active symbol position. It should be noted that in some embodiments, the probability table to be used to determine the active symbol position for a current game instance of the bonus round may be based on how many game instances have occurred since the bonus round has been initiated. For example, in some embodiments the bonus round may end when a certain symbol position is selected as an active symbol position for a current game instance of the bonus round (e.g., when a game character is moved to the symbol position(s) which causes a bonus round to end). In such embodiments, after a predetermined number of game instances (e.g., three (3)), a probability table for selecting an active symbol position may be weighted such that it makes it more probable that the symbol position which causes the end of the bonus round is selected as the active symbol position. For example, in the embodiment of FIG. 5, while a first probability table may be used for a first predetermined number of game instances (e.g., three (3)) to determine what position the game character 515 should be moved to, thereafter a second probability table may be used. The second probability table may, for example, be weighted such that it is more likely that the game character 515 will be moved to one or more certain symbol positions (e.g., the game position 510*o*, which may cause an end of the bonus round, this may be the "jail" position). Of course, in other embodiments other events may cause a bonus round to end (e.g., a player running out of credits, a maximum amount of time and/or a maximum number of game instances occurring, etc.).

In some embodiments, a wager amount may be deducted from a balance of credits or other value for each game instance of a bonus round. For example, turning again to the example embodiment of FIG. 5, a balance of credits as shown in area 536 may show a number of credits or other indication of value the player has as available for placing wagers during the bonus round. In some embodiments, this balance may be based on monetary value the player has provided or won during the primary game. In other embodiments, this balance may be based on some other factor. For example, in some embodiments each bonus round may be initiated with a default balance of bonus round credits usable during the bonus round or a balance the value of which is determined randomly or on one or more factors associated with the player (e.g., a rating of the player, a wagering history of the player, a birthday of the player, a day or time during which the player is playing, etc.). In embodiments in which a wager is deducted from such a balance for each game instance of the bonus round, step 708 (or another step) may comprise deducting the appropriate amount from such a balance of credits. The wager amount may be, for example and without limitation, (i) a default bonus round wager amount, (ii) a wager amount selected by the player; or (iii) a wager amount based on wagers made by the player during play of the primary game. For example, in some embodiments the bonus round wager amount may be determined based on the most recent predetermined number (e.g., the most recent 10) wager amounts made by the player in the primary game (e.g., an average or median wager amount based on the last 10 wagers made by the player) or based on all wagers in the primary game made by the player in a current gambling session. Turning again to the example embodiment of FIG. 5, the wager amount for the current bonus round (however it is determined) may be indicated in area 535 of the interface 500.

It is then determined, in step 710, whether the active symbol position is a player selected symbol position. If it is determined, in step 710, that the active symbol position determined in step 708 is not a player selected symbol position (e.g., in the embodiment of FIG. 5, the game character 515 is made to move to a symbol position onto which a player has not placed any bonus round symbols in the current bonus round), the process 700 continues to step 714, wherein it is determined whether the bonus round is over.

As described herein, there are various events which may cause a bonus round to end, one or more of which may be implemented in various embodiments. For example, a bonus round may be determined to be over upon the satisfaction of at least one of the following conditions: (i) a predetermined number of game instances for the bonus round have been resolved; (ii) a predetermined amount of time since initiation of the bonus round has passed; (iii) a credit balance of credits available for wagering on the bonus round has been depleted or reached an unacceptable level; (iv) an active symbol position has been selected for the current game instance which, when selected for a game instance of the bonus round, causes the bonus round to end; and (v) another event which causes the bonus round to end has occurred. If it is determined in step 714 that the bonus round is over or should be ended, the process 700 may end. Otherwise, the process 700 may return to step 708, in which step a new game instance of the bonus round is initiated and another active symbol position is determined for the new game instance as described above with respect to the initial description of step 708.

If, on the other hand, it is determined that the active symbol position determined in step 708 is a player selected symbol position, then an outcome is determined for the current game instance (step 712). For example, a random or pseudo-random number may be selected, generated, retrieved or otherwise determined and used to determine, based on a probability table, a default value for a prize or a default prize. In some embodiments, a distinct area of a bonus round game interface may be utilized to output an indication of the outcome for the current game instance. For example, in the example embodiment of FIG. 5, the slot reels shown in area 532 may be utilized to show an outcome for the current game instance. For example, if a default value of five (5) credits is determined for the current game instance, the slot reels in area 532 may be spun and made to stop on a symbol combination which corresponds to a prize value of five (5) credits. Any appropriate or desirable game mechanic or interface may be used to show a default prize value or a default prize determined as the outcome for the current game instance. For example, the default prize value may be made to appear on, over or along the active symbol position.

It should be noted that although process 700 is described such than an outcome for a current game instance is determined if an active symbol position is determined to be a player selected symbol position, in other embodiments an outcome may be determined for each game instance of the bonus round irrespective of whether the active symbol position is a player selected symbol position.

In step 716 it is determined whether the outcome determined in step 712 is a winning outcome. For example, it may be determined whether the outcome corresponds to a prize or a prize value greater than some predetermined value (e.g., zero). In some embodiments, the random or pseudo-random determination of a default prize value for a game instance may result in a value of zero (0) or some other value that is below a predetermined threshold and is thus not considered to be a prize value which causes the corresponding outcome to be considered a winning outcome. For example, the reels in area 532 of the game interface 500 (FIG. 5) may be made to stop along a non-winning symbol combination.

If it is determined that the outcome is a winning outcome, the process 700 continues to step 718 in which step a multiplier (or other benefit) is determined for the player, based on the number of bonus round symbols the player placed on the player selected symbol position which is the currently active symbol position and for which a default prize value has been determined. For example, in some embodiments a multiplier of 2× may be applied if 2 bonus round symbols were placed, a multiplier of 3× may be applied if 3 bonus round symbols were placed and a multiplier of 5× may be applied if 4 or more bonus round symbols were placed.

Of course, other benefits may alternatively be provided. For example, a bonus prize amount may be provided in a similar progressive scheme which provides a higher reward to a player the more bonus round symbols the player placed on a given symbol position. In one alternate embodiment, a different prize or benefit may be provided to reward the placement of more than one symbol on a symbol position (e.g., a coupon, discount or credit towards a service or purchase of a product, free plays of the primary game, increase in a player rating, advancement in the primary game, etc.). The nature or type of benefit provided as a reward for placing more than one symbol on a given symbol position is not integral to the implementation of embodiments described herein.

In step 720, the final value of the prize or prizes to be provided to the player as a result of the current game instance is determined and output to the player. This final value of the prize or prizes is based on, in accordance with some embodiments, the default prize or prize value determined in step 712 and the multiplier or other benefit determined in step 718. The prize or prizes so determined may be output to the player in any of a variety of formats or mechanisms. For example, credits may be added to a credit meter balance associated with a player. Such a credit meter balance may comprise, for example, a credit meter balance usable for making wagers in the bonus round, usable for making wagers in the primary game and/or which may be cashed out by the player (e.g., upon a conclusion of the bonus round in some embodiments). In other embodiments, a financial account associated with the player, which is distinct from a credit balance, may be credited based on the value of the prize or prizes. For example, an account of monetary value associated with the player may be increased. In yet another embodiment, if a prize comprises a benefit such as a new ability, feature or resource now available to the player in play of a game (e.g., the primary game), a table which stores an indication of such abilities, features or resources as being available to the player may be updated to reflect the output of such a prize to the player.

If, on the other hand, it is determined in step 716 that the outcome determined in step 712 is not a winning outcome, then the process 700 continues to step 722. In accordance with some embodiments, in the event that an active symbol position is determined to be a player selected symbol position but the outcome for the game instance is not determined to be a winning outcome, the active symbol position is maintained for at least one subsequent game instance of the bonus round in an attempt to achieve a winning outcome. In other words, the game character is not moved to another symbol position or a new active symbol position is not otherwise determined for at least one subsequent bonus round. In some embodiments, the active symbol position determined in step 708 is maintained until a winning outcome is determined. This may be one benefit provided to a player for having selected a symbol position that is determined to be an active symbol position. For example, returning to the MONOPOLY™-themed bonus round interface of FIG. 5, in some embodiments if the game character 715 is placed or "lands" on a symbol position on which a player has placed one or more bonus round symbols, that game character 715 remains on that same symbol position while the reels in area 532 are re-spun until a winning symbol combination is determined along a payline. In some embodiments, the active symbol position may be maintained for consecutive subsequent game instances of the bonus round until either a winning outcome is determined or another qualifying event occurs. Examples of such qualifying events include for example, (i) an occurrence of a maximum number of game instances utilizing the same active symbol position; (ii) an occurrence of a maximum period of time that an active symbol position is maintained as an active symbol position; and/or (iii) a bonus round ends in any of the manners described with respect to step 714. In some embodiments, an additional wager may be deducted from a balance of credits for each outcome determined for the subsequent game instances during which the same active symbol position is maintained while in other embodiments the original wager based on which the active symbol position was originally determined is sufficient an further wagers are not deducted until a new active symbol position is determined (e.g., after an outcome comprising a winning outcome is determined for the current active symbol position). Of course, in some embodiments wagers for bonus round game events may not be deducted at all from any balance of credits. Once a winning outcome is determined, in accordance with some embodiments, the process 700 returns to proceeding to step 718 and continues as described above.

Figure 8:
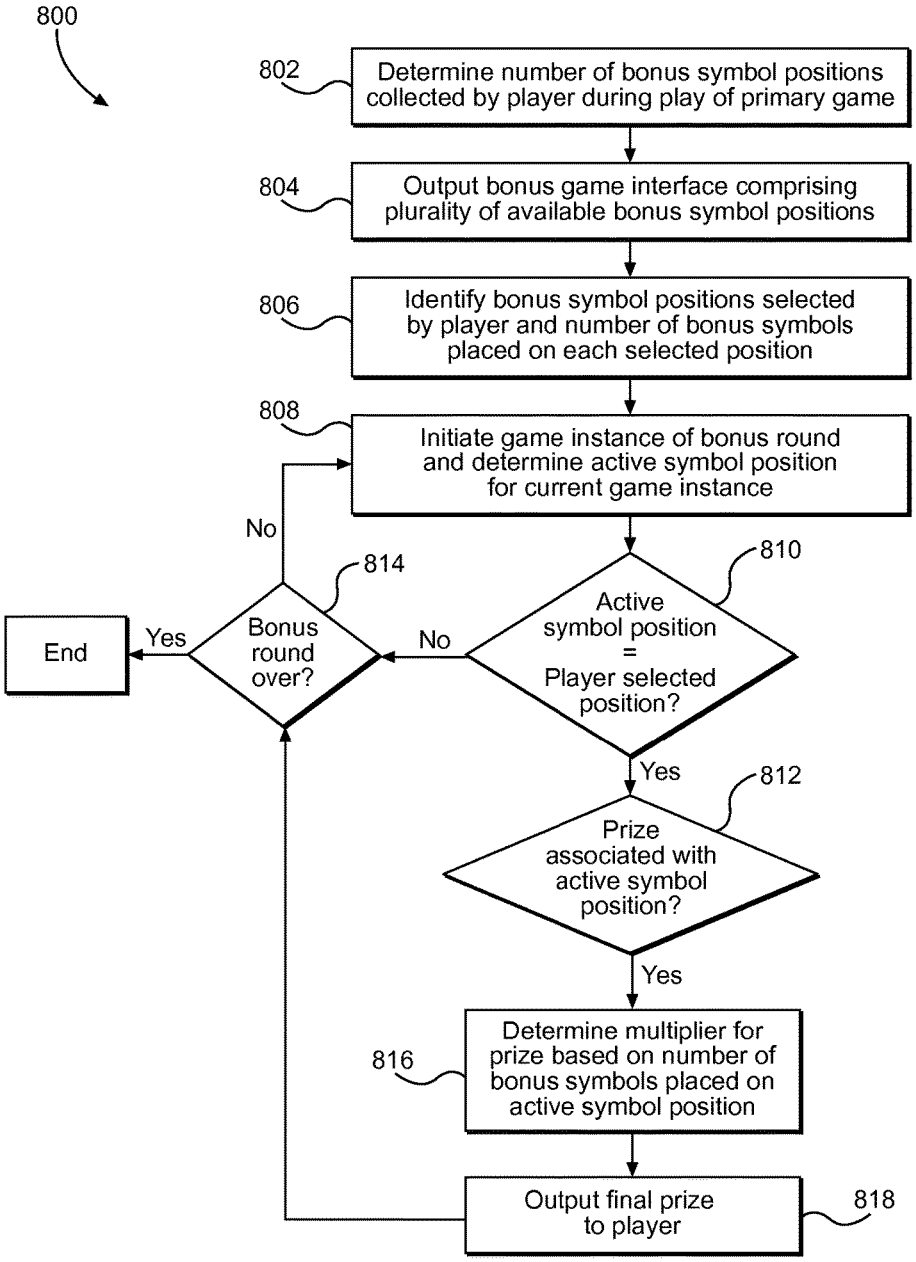
FIG. 8 is a flowchart illustrating a method according to one or more embodiments described herein.

Turning now to FIG. 8, illustrated therein is an example process 800 which is consistent with various embodiments described herein. Process 800 may be performed, for example, by a processor of a server or a player device (e.g., a device 300 of FIG. 3). The process 800 illustrates one method for determining a result of a game instance of a bonus round (e.g., whether a player qualifies for a payout for a particular game instance and, if so, the final value of the payout), wherein each symbol position is pre-associated with a predetermined default payout or other prize value such that determination of the active symbol position and, if that active symbol position is a player selected symbol position, identifying the predetermined default value of the active symbol position.

The steps 802-810 and 814 of FIG. 8 are similar to the steps 702-710 and 714, respectively, of FIG. 7. For example, step 802 corresponds essentially to step 702, step 804 corresponds essentially to step 704, step 806 corresponds essentially to step 706, etc. For purposes of brevity, a detailed description of these steps 802-810 and 814 is not provided herein; rather, the description of the corresponding steps 702-710 and 714 is incorporated by reference herein for the corresponding steps of process 800.

Turning now to step 812, it is determined whether the symbol position determined to be the active symbol position is associated with a prize and, if so, the default prize value is determined. A default prize value, how it may be determined and how it may be used, is described above with respect to step 716 (FIG. 7) and will not be repeated herein for purposes of brevity. It can be appreciated at this point in process 800 that process 800 diverges from process 700 in that once it is determined that the active symbol position determined for the current game instance is a player selected symbol position, it is determined whether a prize or other benefit is associated with the active symbol position. This differs from process 700, which includes a sub-routine for determining an outcome for the active symbol position. Thus, in step 700, an active symbol position determined in a first game instance may be determined to have a first outcome A for it and then, in a second game instance at some point later in the bonus round if the same symbol position is determined to be an active symbol position, a determination of an outcome in step 712 may result in a second outcome B being determined for that active symbol position. In other words, in the embodiment of process 700, outcomes or prizes or prize values are not predetermined or pre-associated with specific symbol positions and the determination of an outcome for a game instance is a distinct process from a determination of an active symbol position (hence the possibility of maintaining a symbol position as an active symbol position over a plurality of consecutive game instances while determining different outcomes for each game instance, as described with respect to step 722). In process 800, by contrast, each symbol position is pre-associated with a single outcome, prize, prize value or other benefit such that determining the active symbol position also determines the outcome, prize, prize value or other benefit for the game instance. For example, turning to the embodiment of FIG. 6, the wheel interface of such an embodiment has associated with each symbol position 610*a* through 610*i* a prize or prize value such that if any of these symbol positions is determined to be an active symbol position for a given game instance, the prize of that active symbol position is determined to be the default prize value.

In some embodiments a given symbol position may not be associated with any prize, or may be associated with a prize value of zero (0). In such embodiments, if it is determined in step 812 that a prize is not associated with the symbol position determined to be the active symbol position, the process 800 continues to step 814, in which step it is determined whether the bonus round is over.

Step 816 comprises determining a multiplier or other benefit to provide to the player based on a number of bonus round symbols the player placed on the player selected symbol position which has been determined to be an active symbol position for the current game instance. Step 816 is analogous to step 718 of FIG. 7 and the description thereof is incorporated by reference herein for purposes of brevity. A final prize or prize value is determined in step 818 based on the information determined in step 816 and the default prize value determined in step 814. Step 818 of determining a final prize and outputting it to the player is analogous to step 720 of FIG. 7 and the description thereof is incorporated by reference herein for purposes of brevity.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

Rules of Interpretation

The Title (set forth at the beginning of the first page of this disclosure) is not to be taken as limiting in any way as the scope of the disclosed invention(s).

The term "product" means any machine, manufacture and/or composition of matter as contemplated by 35 U.S.C. §101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "and/or", when such term is used to modify a list of things or possibilities (such as an enumerated list of possibilities) means that any combination of one or more of the things or possibilities is intended, such that while in some embodiments any single one of the things or possibilities may be sufficient in other embodiments two or more (or even each of) the things or possibilities in the list may be preferred, unless expressly specified otherwise. Thus for example, a list of "a, b and/or c" means that any of the following interpretations would be appropriate: (i) each of "a", "b" and "c"; (ii) "a" and "b"; (iii) "a" and "c"; (iv) "b" and "c"; (v) only "a"; (vi) only "b"; and (vii) only "c."

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device, component or article is described herein, more than one device, component or article (whether or not they cooperate) may alternatively be used in place of the single device, component or article that is described. Accordingly, the functionality that is described as being possessed by a device may alternatively be possessed by more than one device, component or article (whether or not they cooperate).

Similarly, where more than one device, component or article is described herein (whether or not they cooperate), a single device, component or article may alternatively be used in place of the more than one device, component or article that is described. For example, a plurality of computer-based devices may be substituted with a single computer-based device. Accordingly, the various functionality that is described as being possessed by more than one device, component or article may alternatively be possessed by a single device, component or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, Digital Light Processing (DLP), rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as Standard Definition Television (SDTV), Enhanced Definition TV (EDTV), High Definition TV (HDTV), or the like. The information may likewise be static, in which case, painted glass may be used to form the display. Note that static information may be presented on a display capable of displaying dynamic information if desired. Some displays may be interactive and may include touch screen features or associated keypads as is well understood.

The present disclosure may refer to a "control system" or program. A control system or program, as that term is used herein, may be a computer processor coupled with an operating system, device drivers, and appropriate programs (collectively "software") with instructions to provide the functionality described for the control system. The software is stored in an associated memory device (sometimes referred to as a computer readable medium). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, Central Processing Unit (CPU) devices, computing devices, microcontrollers, digital signal processors, or like devices. Exemplary processors are the INTEL PENTIUM or AMD ATHLON processors.

The term "computer-readable medium" refers to any statutory medium that participates in providing data (e.g., instructions) that may be read by a computer, a processor or a like device. Such a medium may take many forms, including but not limited to non-volatile media, volatile media, and specific statutory types of transmission media. Non-volatile media include, for example, optical or magnetic disks and other persistent memory. Volatile media include DRAM, which typically constitutes the main memory. Statutory types of transmission media include coaxial cables, copper wire and fiber optics, including the wires that comprise a system bus coupled to the processor. Common forms of computer-readable media include, for example, a floppy disk, a flexible disk, hard disk, magnetic tape, any other magnetic medium, a CD-ROM, Digital Video Disc (DVD), any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read. The terms "computer-readable memory" and/or "tangible media" specifically exclude signals, waves, and wave forms or other intangible or non-transitory media that may nevertheless be readable by a computer.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, LAN, WAN or Ethernet (or IEEE 802.3), Token Ring, or via any appropriate communications means or combination of communications means. Exemplary protocols include but are not limited to: Bluetooth™, Time Division Multiple Access (TDMA), Code Division Multiple Access (CDMA), Global System for Mobile communications (GSM), Enhanced Data rates for GSM Evolution (EDGE), General Packet Radio Service (GPRS), Wideband CDMA (WCDMA), Advanced Mobile Phone System (AMPS), Digital AMPS (D-AMPS), IEEE 802.11 (WI-FI), IEEE 802.3, SAP, the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cable TV, satellite links, and the like. Where appropriate encryption or other security measures such as logins and passwords may be provided to protect proprietary or confidential information.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium and/or memory for performing the process. The apparatus that performs the process can include components and devices (e.g., a processor, input and output devices) appropriate to perform the process. A computer-readable medium can store program elements appropriate to perform the method.

What is claimed is:

1. A non-transitory computer-readable medium storing instructions thereon, the instructions when read by a processor of a computing device, causing the processor to perform a method, the method comprising:

determining, by a processing device, that a first player of a primary game has qualified for entry into a bonus round of the primary game;

outputting, via a player device associated with the player, a game interface of the bonus round, the game interface comprising a plurality of available symbol positions available for selection by the player;

determining at least one element available to the player due to having been obtained by the player as a result of game play of the primary game and as a result of the player having placed at least one qualifying wager for the primary game, the at least one element being available to the player for placement during the bonus round on the available symbol position of the plurality of available symbol positions without requiring any additional wager from the player for the bonus round, wherein the player may place more than one of the at least one element on a particular available symbol position in order to increase a default value of a prize associated with the symbol position and wherein the player only has available for placement in the bonus round the at least one element obtained by the player as a result of game play of the primary game;

determining which of the available symbol positions the player has placed one or more elements on, thereby determining at least one player selected symbol position;

determining, for a game instance of the bonus round, an active symbol position for the game instance;

determining, for the game instance, an outcome and a prize corresponding to the outcome;

determining whether the active symbol position is a player selected symbol position;

if the active symbol position is a player selected symbol position, retaining the active symbol position as an active position for a plurality of game instances of the bonus round until a prize is awarded to the player for the active position, not moving a game character further along a game interface until the prize is awarded and determining a final value of the prize to output to the player based on a default value of the prize and a number of elements the player has placed on the player selected symbol position; and outputting the prize of the final value to the player.

2. The non-transitory computer readable medium of claim 1, wherein determining an active position for the game instance of the bonus round comprises determining a position of the available symbol positions for placement of a game character of the bonus round.

3. The non-transitory computer readable medium of claim 1, the method further comprising, prior to outputting the actual prize value to the player, determining whether the outcome corresponds to a prize having a default value greater than a minimum value and, if the outcome does not correspond to a prize having a default value greater than a minimum value, repeatedly determining a new outcome for the game instance until a game outcome corresponding to a prize having a default value greater than the minimum value is determined.

4. The non-transitory computer readable medium of claim 3, wherein the minimum value is zero.

5. The non-transitory computer readable medium of claim 1, wherein determining the actual value of the prize comprises applying a multiplier to the default value, the multiplier being based on the number of elements placed by the player on the player selected symbol position.

6. A gaming system for facilitating a game which allows a player to influence the volatility of the game, the gaming system comprising:

a processor; and a memory storing a program, the processor being operable with the program to:

determine that a first player of a primary game has qualified for entry into a bonus round of the primary game;

output, via a player device associated with the player, a game interface of the bonus round, the game interface comprising a plurality of available symbol positions available for selection by the player;

determine at least one element available to the player due to having been obtained by the player as a result of game play of the primary game and as a result of the player having placed at least one qualifying wager for the primary game, the at least one element being available to the player for placement during the bonus round on the available symbol position of the plurality of available symbol positions without requiring any additional wager from the player for the bonus round, wherein the player may place more than one of the at least one element on a particular available symbol position in order to increase a default value of a prize associated with the symbol position and wherein the player only has available for placement in the bonus round the at least one element obtained by the player as a result of game play of the primary game;

determine which of the available symbol positions the player has placed one or more elements on, thereby determining at least one player selected symbol position;

determine, for a game instance of the bonus round, an active symbol position for the game instance;

determine, for the game instance, an outcome and a prize corresponding to the outcome;

determine whether the active symbol position is a player selected symbol position;

if the active symbol position is a player selected symbol position, retain the active symbol position as an active position for a plurality of game instances of the bonus round until a prize is awarded to the player for the active position, not moving a game character further along a game interface until the prize is awarded and determine a final value of the prize to output to the player based on a default value of the prize and a number of elements the player has placed on the player selected symbol position; and output the prize of the final value to the player.

7. The gaming system of claim 6, wherein determining an active position for the game instance of the bonus round comprises determining a position of the available symbol positions for placement of a game character of the bonus round.

8. The gaming system of claim 6, wherein the processor is operable with the program to, prior to outputting the actual prize value to the player, determine whether the outcome corresponds to a prize having a default value greater than a minimum value and, if the outcome does not correspond to a prize having a default value greater than a minimum value, repeatedly determine a new outcome for the game instance until a game outcome corresponding to a prize having a default value greater than the minimum value is determined.

9. The gaming system of claim 8, wherein the minimum value is zero.

10. The gaming system of claim 6, wherein determining the actual value of the prize comprises applying a multiplier to the default value, the multiplier being based on the number of elements placed by the player on the player selected symbol position.

* * * * *